US010761458B2

(12) United States Patent
Takeuchi

(10) Patent No.: US 10,761,458 B2
(45) Date of Patent: Sep. 1, 2020

(54) IMAGE FORMING APPARATUS

(71) Applicant: CANON KABUSHIKI KAISHA, Tokyo (JP)

(72) Inventor: Yasushi Takeuchi, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/548,863

(22) Filed: Aug. 23, 2019

(65) Prior Publication Data

US 2020/0073291 A1 Mar. 5, 2020

(30) Foreign Application Priority Data

Aug. 29, 2018 (JP) ..... 2018-160681

(51) Int. Cl.
*G03G 15/16* (2006.01)

(52) U.S. Cl.
CPC ..... *G03G 15/161* (2013.01); *G03G 15/1665* (2013.01)

(58) Field of Classification Search
CPC ..... G03G 15/161; G03G 21/0035; G03G 21/0076; G03G 2215/1661; G03G 2221/001
See application file for complete search history.

(56) References Cited

U.S. PATENT DOCUMENTS 7,242,887 B2 7/2007 Takeuchi et al.
7,366,438 B2 4/2008 Takeuchi et al.
7,433,626 B2 10/2008 Takeuchi
7,650,094 B2 1/2010 Yamamoto et al.
7,937,011 B2 5/2011 Yamamoto et al.
8,185,011 B2 * 5/2012 Shibuya ..... G03G 15/161 15/256.52
2005/0058474 A1 * 3/2005 Watanabe ..... G03G 21/0035 399/353
2007/0230993 A1 * 10/2007 Takeuchi ..... G03G 15/161 399/101

(Continued)

FOREIGN PATENT DOCUMENTS

JP 2006-146189 A 6/2006
JP 2011-197260 A 10/2011

(Continued)

*Primary Examiner* — Walter L Lindsay, Jr.
*Assistant Examiner* — Jessica L Eley
(74) *Attorney, Agent, or Firm* — Venable LLP

(57) ABSTRACT

An image forming apparatus includes an image bearing member; an intermediary image transfer belt; primary and secondary transfer members; a first cleaning member; a second cleaning member; an electrical discharge member; a voltage source for supplying a voltage to produce the discharge current; and a controller, which controls the voltage source such that an absolute value of a first current balance is not more than 50% of an absolute value of a second current balance. The first current balance is a sum of a primary transferring current, a secondary-transfer current, a first cleaning current, a second cleaning current and a discharge current at the time when an image region on the belt passes the primary transfer member, the secondary transfer member, the first cleaning member, the second cleaning member and the discharge member, respectively, and the second balance is the first balance minus the discharge current.

16 Claims, 13 Drawing Sheets

(56) References Cited

U.S. PATENT DOCUMENTS

| | | | | |
|---|---|---|---|---|
| 2008/0187352 | A1* | 8/2008 | Takeuchi | G03G 15/161 399/101 |
| 2011/0229187 | A1* | 9/2011 | Hozumi | G03G 15/161 399/101 |
| 2015/0338791 | A1* | 11/2015 | Matsushita | G03G 15/1615 399/66 |
| 2016/0124353 | A1* | 5/2016 | Nakaegawa | G03G 15/1605 399/66 |
| 2018/0224774 | A1 | 8/2018 | Takayanagi | |

FOREIGN PATENT DOCUMENTS

| | | | |
|---|---|---|---|
| JP | 2013-057811 | A | 3/2013 |
| JP | 2015-172660 | A | 10/2015 |
| JP | 2018-128613 | A | 8/2018 |

* cited by examiner (a)

(b)

(a)

(b)

(a)

(b)

IMAGE FORMING APPARATUS

FIELD OF THE INVENTION AND RELATED ART

The present invention relates to an image forming apparatus, such as a copying machine, a printing machine, and a facsimile machine, which uses an electrophotographic recording method, an electrostatic recording method, or the like.

There are various image forming apparatuses which employ an electrophotographic image forming method or the like. One of such image forming apparatuses is an image forming apparatus of the so-called intermediary transfer type, which forms toner images on two or more image bearing members, one for one, transfers (primary transfer) the toner images onto its intermediary transferring member in such a manner that the images are sequentially transferred in layers onto the intermediary transferring member, and transfers (secondary transfer) the layered toner images onto recording medium such as a sheet of paper. As the intermediary transferring member, an intermediary transfer belt, which is in the form of an endless belt, is widely used. Generally speaking, during the primary transfer, primary bias is applied to each of the primary transferring members disposed in contact with the inward surface of the intermediary transfer belt, in such a manner that each primary transferring member opposes the corresponding image bearing member. Thus, electric current is supplied to the primary transferring portion, which is the area of contact between the image bearing member and intermediary transfer belt. As for the secondary transfer, the secondary transfer bias is applied to the secondary transferring member disposed in contact with the outward surface of the intermediary transfer belt. Thus, electric current is supplied to the secondary transferring portion, which is the area of contact between the intermediary transfer belt and secondary transferring member. As the first and second transferring members, the first and second transfer rollers, are used, respectively, which are members in the form of a roller, as for the secondary transfer residual toner, that is, the toner which is remaining on the intermediary transfer belt after the secondary transfer, is recovered by a belt cleaning apparatus as a means for cleaning the intermediary transferring member. The belt cleaning apparatus is used also for recovering a test toner image (which is not transferred onto recording medium) formed on the intermediary transfer belt to control an image forming apparatus in image density. As a belt cleaning apparatus, an electrostatic cleaning apparatus has been known, which electrostatically recovers the toner on the intermediary transfer belt (Japanese Laid-open Patent Application No. 2006-146189). An electrostatic cleaning apparatus is effective to clean such an intermediary transfer belt that has an elastic layer, which makes it difficult to clean the belt with the use of a cleaning blade, because the presence of the elastic layer increases the friction between the cleaning blade and belt.

In the case of an image forming apparatus such as the one described above, as electric current is flowed through its intermediary transfer belt during an image forming operation, the belt sometimes increases in electrical resistance. The occurrence of this phenomenon is more apparent when an ion-conductive belt is used as the intermediary transfer belt, in particular, in a case where the intermediary transfer belt is provided with multiple layers, for example, a substrative layer, an elastic layer, and a surface layer, and an ion-conductive agent is used to adjust the elastic layer in electrical resistance. That is, in a case where an ion-conductive belt is used as the intermediary transfer belt, the positive and negative ions which are related to the ion-conductivity of the belt, are affected by the force generated by the electric field which occurs as electric current flows through the belt. Thus, the positive ions, that is, the ions having positive charge, move in the direction of the electric field, whereas the negative ions, that is, the ions having negative charge move in the opposite direction from that of the electric field. Let's assume here that an image forming apparatus is structured to use toner, which is inherently negative in polarity. In such a case, positive voltage is applied to the primary transferring member, which is in contact with the inward surface of the intermediary transfer belt, for the primary transfer. Thus, the primary transferring portion is supplied with such electric current that flows from the inward surface side of the intermediary transfer belt to the outward surface side of the intermediary transfer belt (which hereafter may be referred to simply as "outward" current). Thus, the positive ions move toward the outward surface side of the intermediary transfer belt, and the negative ions move toward the inward surface side of the intermediary transfer belt. Further, positive voltage is applied to the secondary transferring member, which is in contact with the outward surface of the intermediary transfer belt, for the secondary transfer. Therefore, the secondary transferring portion is supplied with such electric current that flows from the outward surface side of the intermediary transfer belt toward the inward surface side of the intermediary transfer belt (which hereafter may be referred to simply as "inward" current). Thus, the ions in the intermediary transfer belt move in the opposite direction from the direction in which they flow during the primary transfer (positive ions move inward, and negative ions move outward). Consequently, the intermediary transfer belt is substantially affected in terms of the balance between the outward charge and inward charge. As the intermediary transfer belt becomes unbalanced in the total amount of outward charge and the total amount of inward charge, the intermediary transfer belt increases in electrical resistance. Thus, as the intermediary transfer belt increases in the cumulative amount of repetitious usage, it substantially increases in electrical resistance, which in turn increases in absolute value, the voltages which have to be applied for the first and second transfers. As a result, electrical discharge occurs in the primary transferring portion and/or secondary transferring portion, making it likely for an image forming to output unsatisfactory images.

According to the studies conducted by the inventors of the present invention, as a means for preventing the intermediary transfer belt from increasing in electric resistance, to prevent the intermediary transfer belt from being reduced in life expectancy (durability), it is effective to provide the intermediary transfer belt with such electric current that flows in the direction to undo the ion deviation in the intermediary transfer belt, which was caused by an image forming operation. As a member for supplying the intermediary transfer belt with electric current, the cleaning member of the afore-mentioned electrostatic cleaning apparatus is feasible. There is disclosed in Japanese Laid-open Patent Application No. 2018-128613, an image forming apparatus structured so that a current supplying means for supplying the intermediary transfer belt with electric current is disposed on the downstream side of two fur brushes for electrostatically cleaning the intermediary transfer belt, and on the upstream side of the primary transferring portion. In the case of this image forming apparatus, electric current is flowed from the current supplying means to the intermediary transfer belt to prevent the intermediary transfer belt from increasing in electric resistance.

However, the electric current which is necessary to satisfactorily undo the ion deviation in the intermediary transfer belt during an image forming operation sometimes, becomes greater than the proper amount of electric current (which sometimes is referred to as "optimal cleaning current) for recovering the secondary transfer residual toner on the intermediary transfer belt. For example, in the case of a full-color image forming apparatus of the so-called tandem type, outward electric current flows through the intermediary transfer belt in each of the four primary transferring portions, whereas inward electric current flows through the intermediary transfer belt only in the secondary transferring portion. That is, the outward electric current is likely to be greater than the inward electric current. Therefore, if an attempt is made to undo the ion deviation in the intermediary transfer belt, by supplying the intermediary transfer belt with inward electric current, the current, with which the intermediary transfer belt needs to be supplied, sometimes becomes greater than the optimal cleaning current.

If such electric current that is greater the optimal cleaning current is supplied to the current supplying means during an image forming operation, it is possible that toner re-adheres to the intermediary transfer belt, making it possible that the image on the next sheet of recording medium will be soiled by the re-adhered toner. In particular, if toner continues to accumulate on the current supplying means, because such electric current is supplied, the toner on the current supplying means sometimes re-adheres to the intermediary transfer belt all at once. Thus, as toner accumulates on the current supplying means by a certain amount, it is necessary to carry out the operational sequence for cleaning the current supplying means, and therefore, it is possible for the image forming apparatus to reduce in productivity.

SUMMARY OF THE INVENTION

Therefore, the primary object of the present invention is to provide an image forming apparatus which does not suffer from the problem that the intermediary transferring member of an image forming apparatus temporarily increases in electrical resistance during an image forming operation, and therefore, does not suffer from the problem that an image forming apparatus reduces in productivity because of the cleaning of its member for supplying its intermediary transferring member with current.

The object of the present invention described above can be embodied in the form of an image forming apparatus.

According to an aspect of the present invention, there is provided an image forming apparatus comprising an image bearing member configured to carry a toner image; an intermediary transfer belt configured to receive the toner image from said image bearing member; a primary transfer member provided in contact with said intermediary transfer belt at a primary transfer portion and configured to primary-transfer the toner image from said image bearing member onto said intermediary transfer belt by supplying a primary transferring current to said intermediary transfer belt; a secondary transfer member provided in contact with said intermediary transfer belt at a secondary transfer portion and configured to secondary-transfer the toner image from said intermediary transfer belt onto the recording material by supplying a secondary-transfer current to said intermediary transfer belt; a first cleaning member provided in contact with said intermediary transfer belt at a position downstream of said secondary transfer portion and upstream of said primary transfer portion in a rotational moving direction of said intermediary transfer belt, said first cleaning member being configured to collect the toner charged to a regular polarity from said intermediary transfer belt by supplying a first cleaning current to said intermediary transfer belt; a second cleaning member provided in contact with said intermediary transfer belt and a position downstream of said secondary transfer portion and the upstream of said primary transfer portion in the rotational moving direction of said intermediary transfer belt, said second cleaning member and being configured to collect the toner charged to a polarity opposite to the regular polarity from said intermediary transfer belt upper by supplying a second cleaning current to said intermediary transfer belt; a discharge member provided in contact with said intermediary transfer belt at a discharging portion downstream of said secondary transfer portion and upstream of said first cleaning portion in the rotational moving direction of said intermediary transfer belt, said discharge member being configured to supply a discharge current to said intermediary transfer belt; a voltage source for supplying a voltage to produce said discharge current; and a controller configured to control said voltage source such that an absolute value of a first current balance is not more than 50% of an absolute value of a second current balance, in which the first current balance is a sum of the primary transferring current, the secondary-transfer current, the first cleaning current, the second cleaning current and the discharge current at the time when an image region on said intermediary transfer belt passes the primary transfer portion, and the secondary transfer portion, the first cleaning portion, the second cleaning portion and the discharge portion, respectively, the second current balance is the first current balance minus the discharge current, when the current in a direction from an inner surface side toward an outer peripheral surface side of said intermediary transfer belt is taken as positive current.

Further features of the present invention will become apparent from the following description of exemplary embodiments with reference to the attached drawings.

Figure 4:
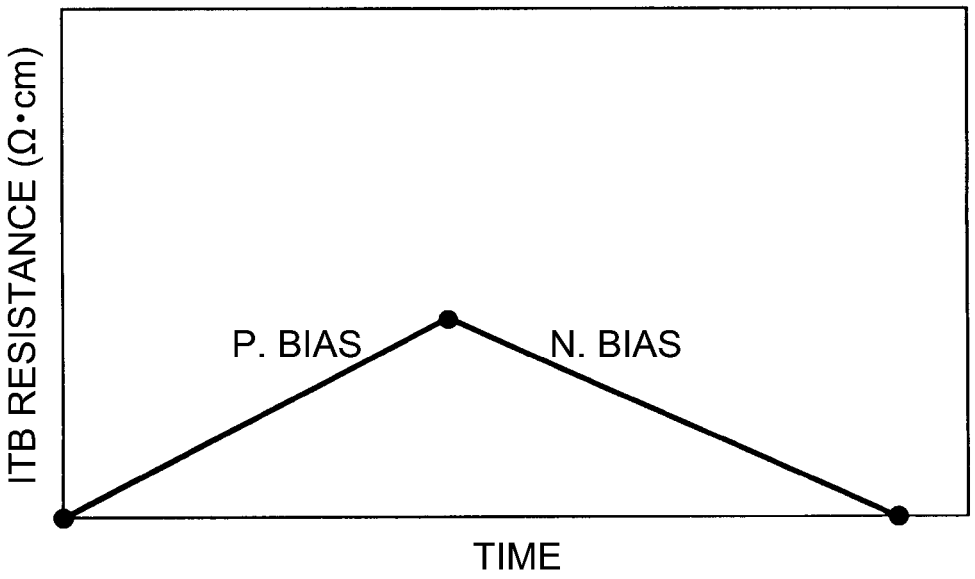
Figure 4:
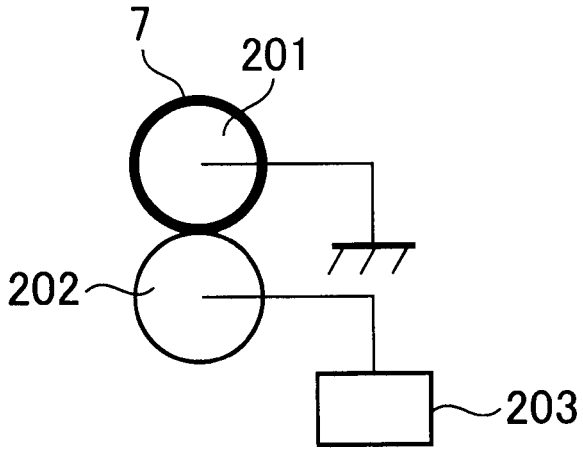

Part (a) of FIG. 4 is a combination of a graph which shows the relationship between the length of voltage application (electric current application) to the intermediary transfer belt and the amount of electric resistance of the intermediary transfer belt, and part (b) of FIG. 4 illustrates the apparatus for measuring the electric resistance of the intermediary transfer belt.

Figure 5:
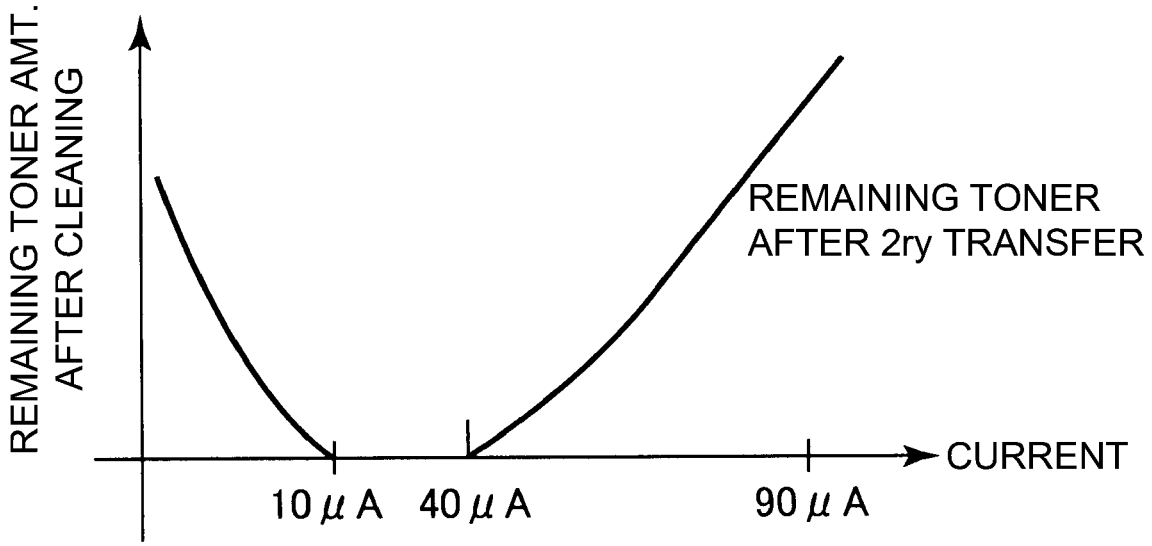

FIG. 5 is a graph for showing the cleaning performance of the second cleaning brush, regarding the removal of the secondary transfer residual toner.

Figure 6:
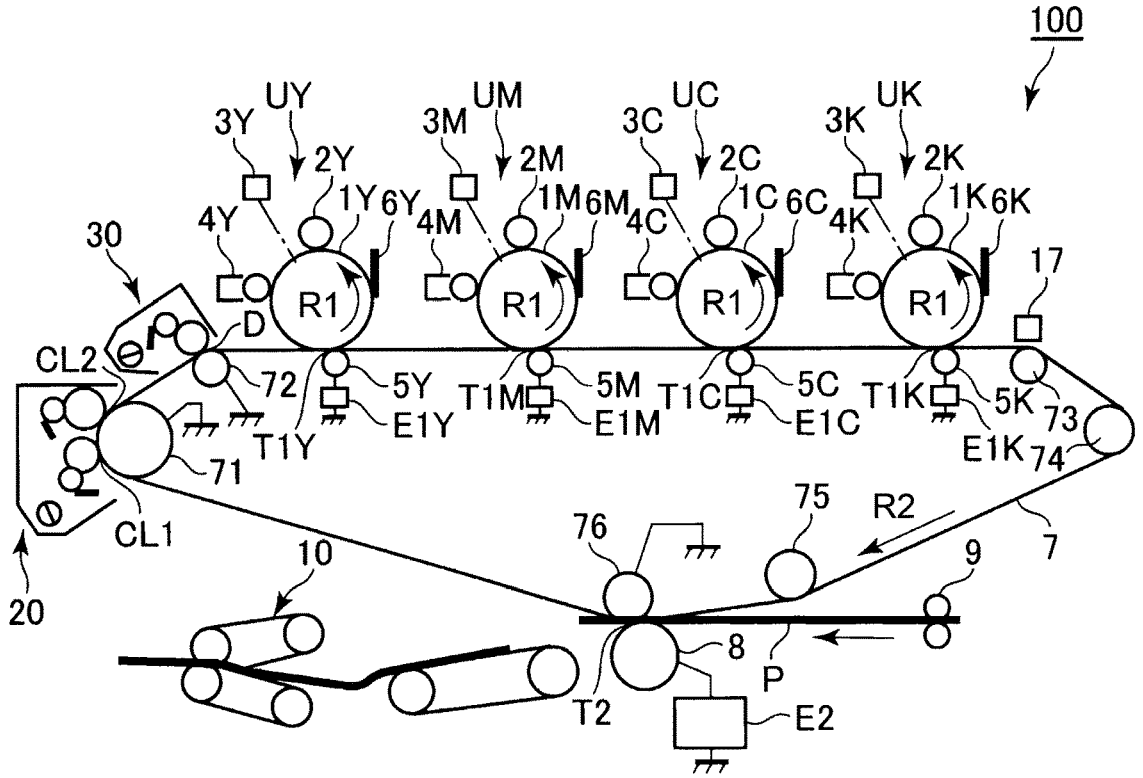
Figure 6:
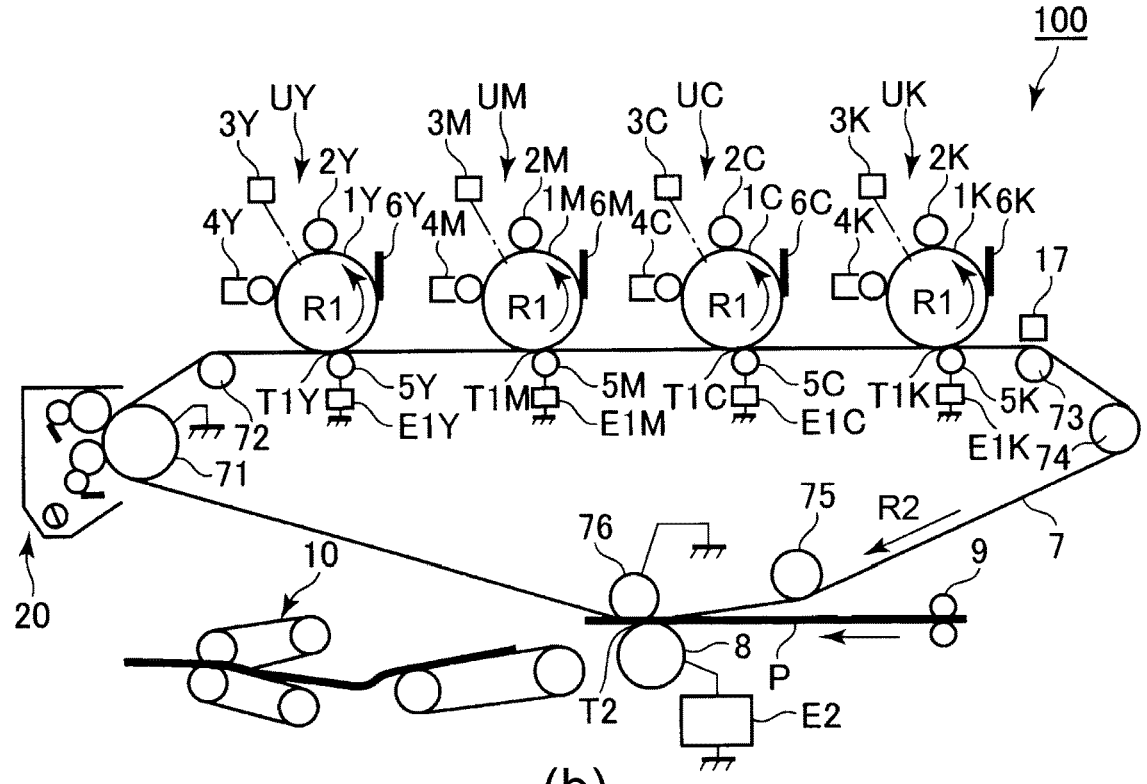

Parts (a) and (b) of FIG. 6 are a combination of a schematic sectional view of the first comparative image forming apparatus, and that of the second comparative image forming apparatus.

Figure 7:
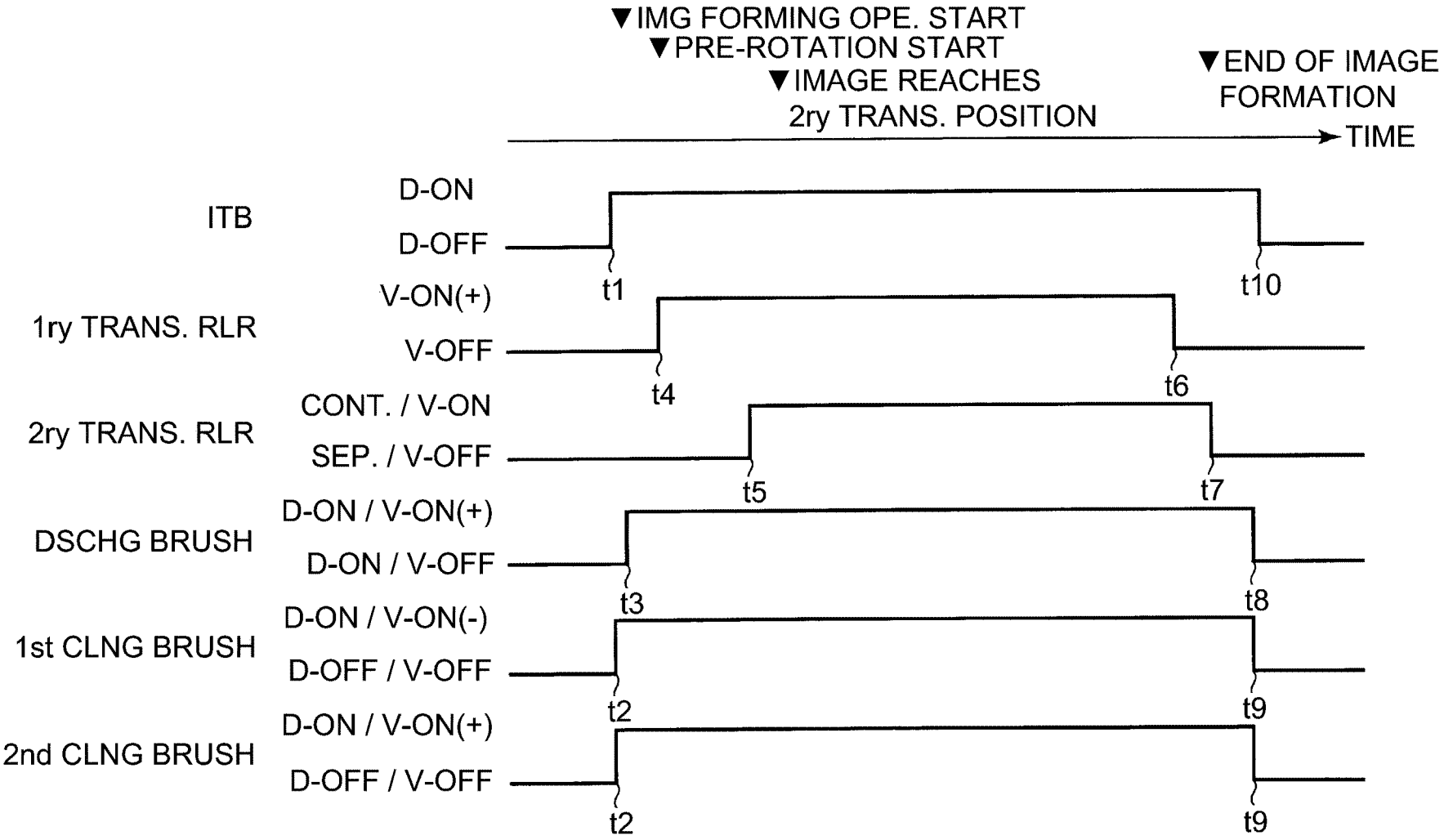

FIG. 7 is a timing chart of the image formation sequence in the first embodiment.

Figure 8:
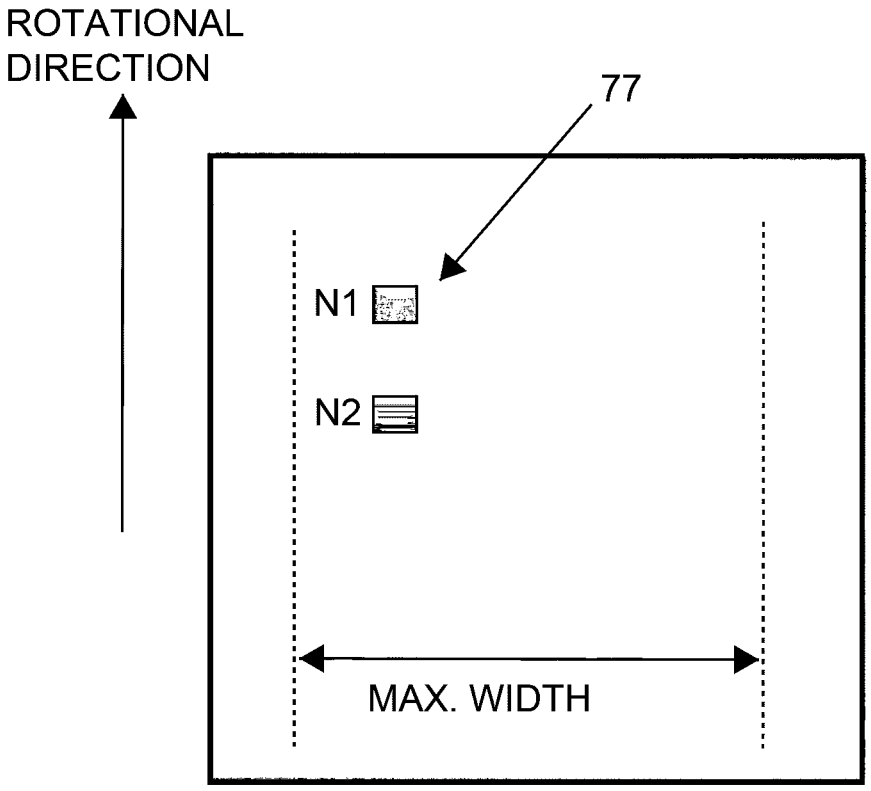

FIG. 8 is a schematic drawing for showing the positioning of the patterned images for controlling the image forming apparatus in image density.

Figure 9:
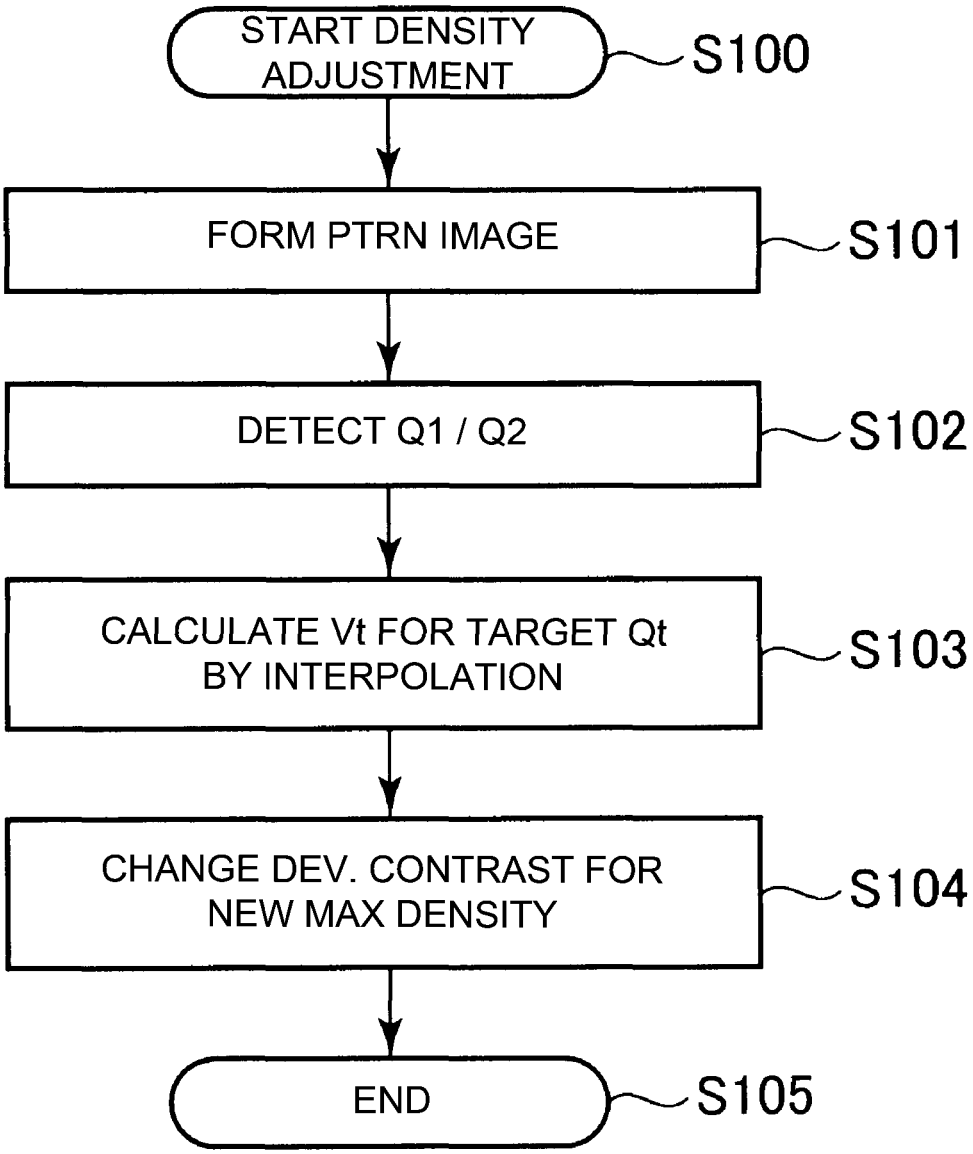

FIG. 9 is a flowchart of the operational sequence for controlling the image forming apparatus in image density.

Figure 10:
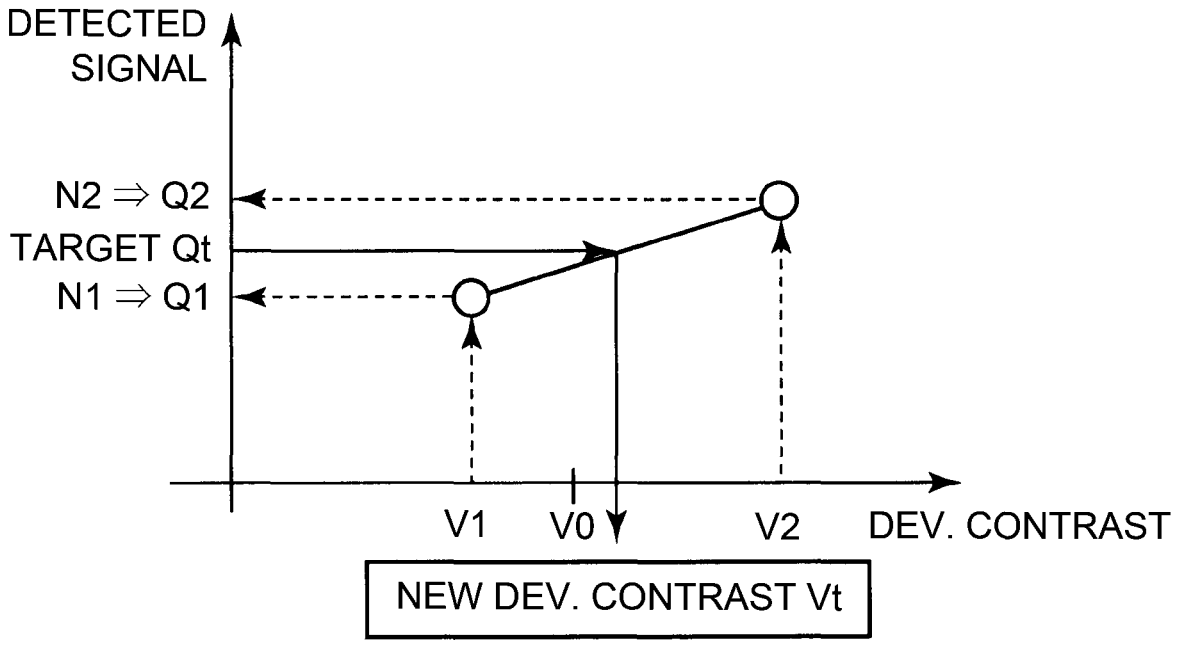

FIG. 10 is a graph for showing the relationship between the signal value and the potential level, which occurs during the operation for controlling the image forming apparatus in image density.

Figure 11:
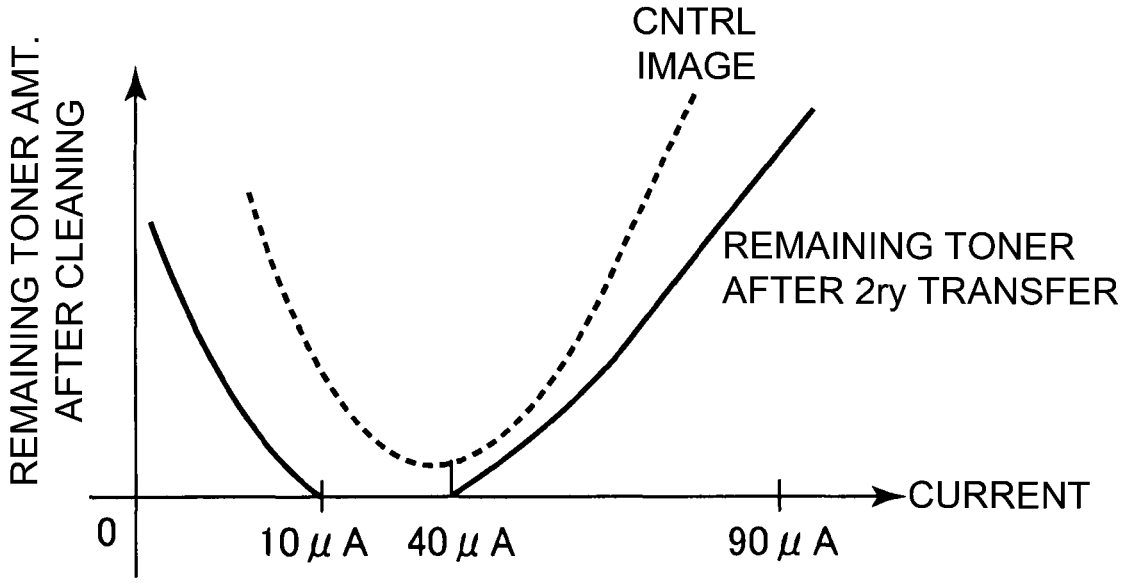

FIG. 11 is a graph for showing the cleaning performance of the second cleaning brush, regarding the removal of the test toner image.

Figure 12:
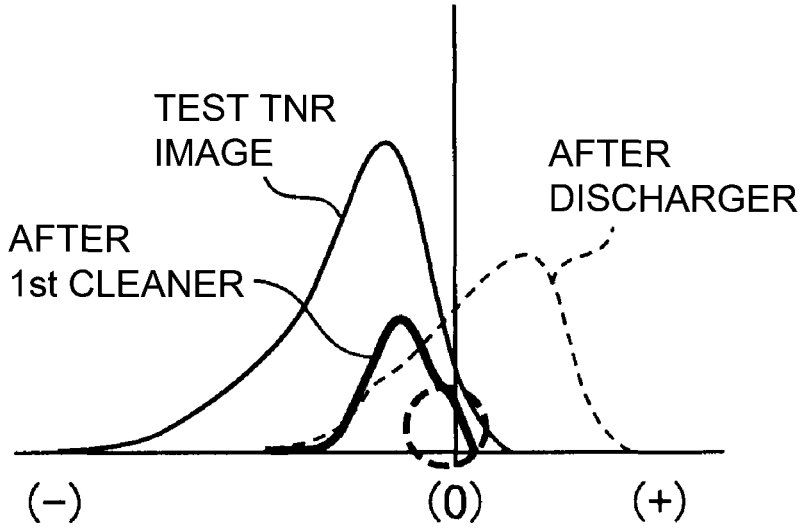
Figure 12:
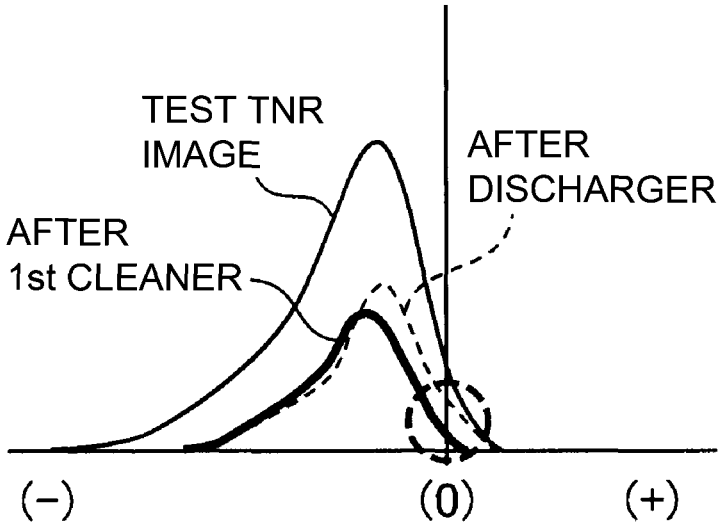

FIG. 12 is a graph for describing the distribution of the toner charge in terms of amount across the intermediary transfer belt.

Figure 13:
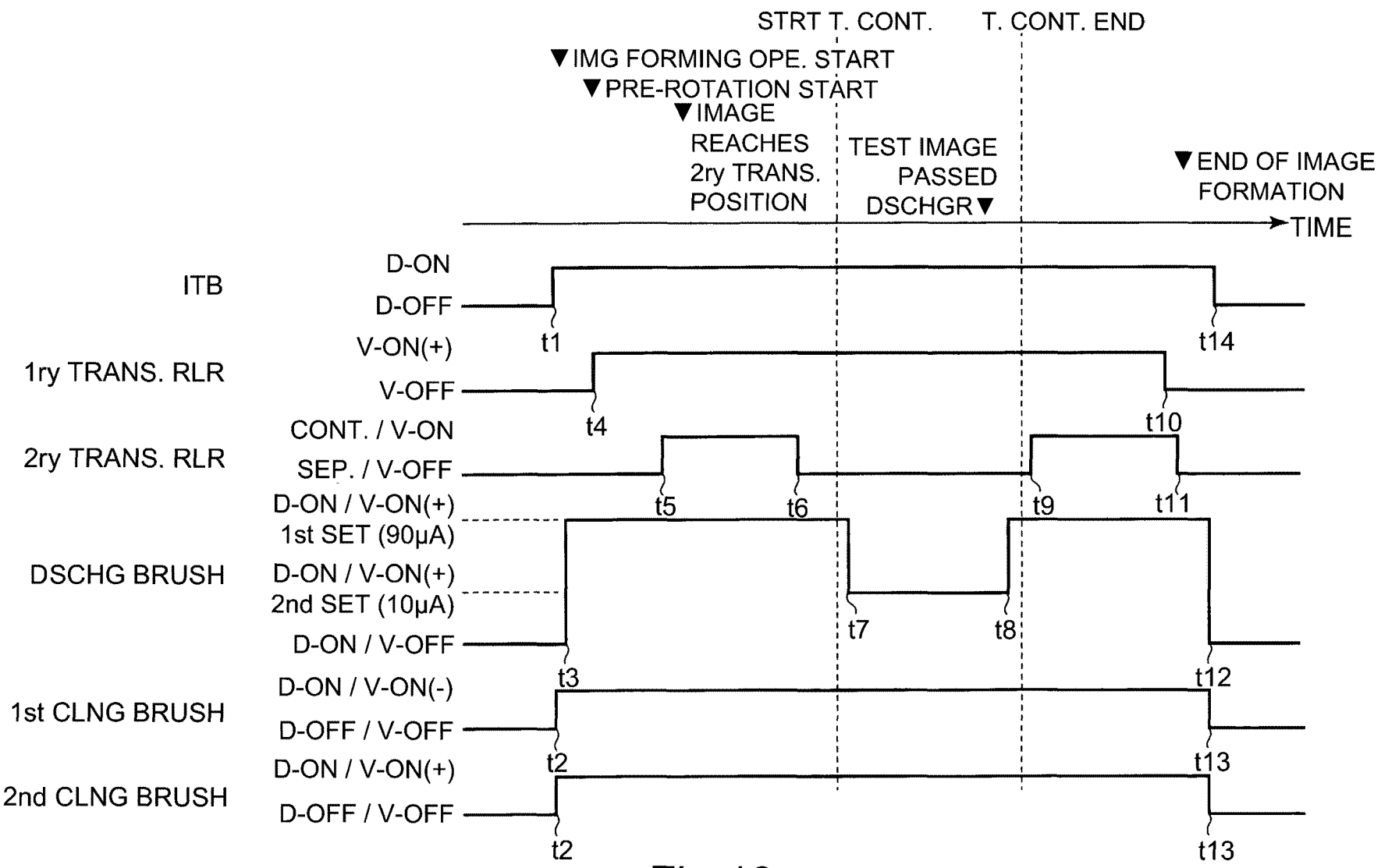

FIG. 13 is a timing chart for describing the image formation sequence in the second embodiment of the present invention.

Figure 14:
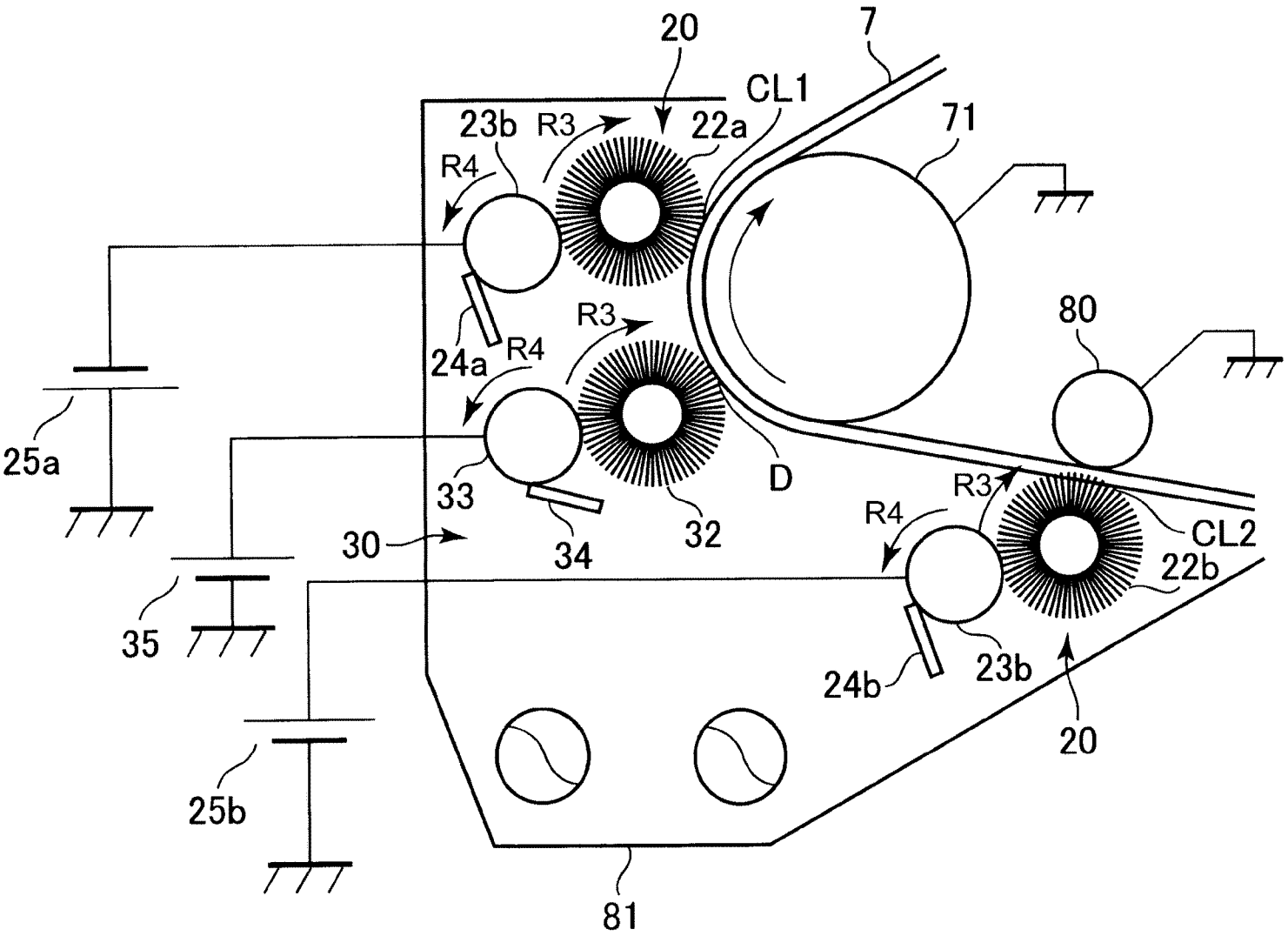

FIG. 14 is a schematic sectional view of the belt cleaning apparatus and discharging portion, and their adjacencies, in the third embodiment of the present invention.

DESCRIPTION OF THE EMBODIMENTS

Next, the image forming apparatus which is in accordance with the present invention is described in greater detail with reference to appended drawings.

1. Overall Structure and Operation of Image Forming Apparatus

Figure 1:
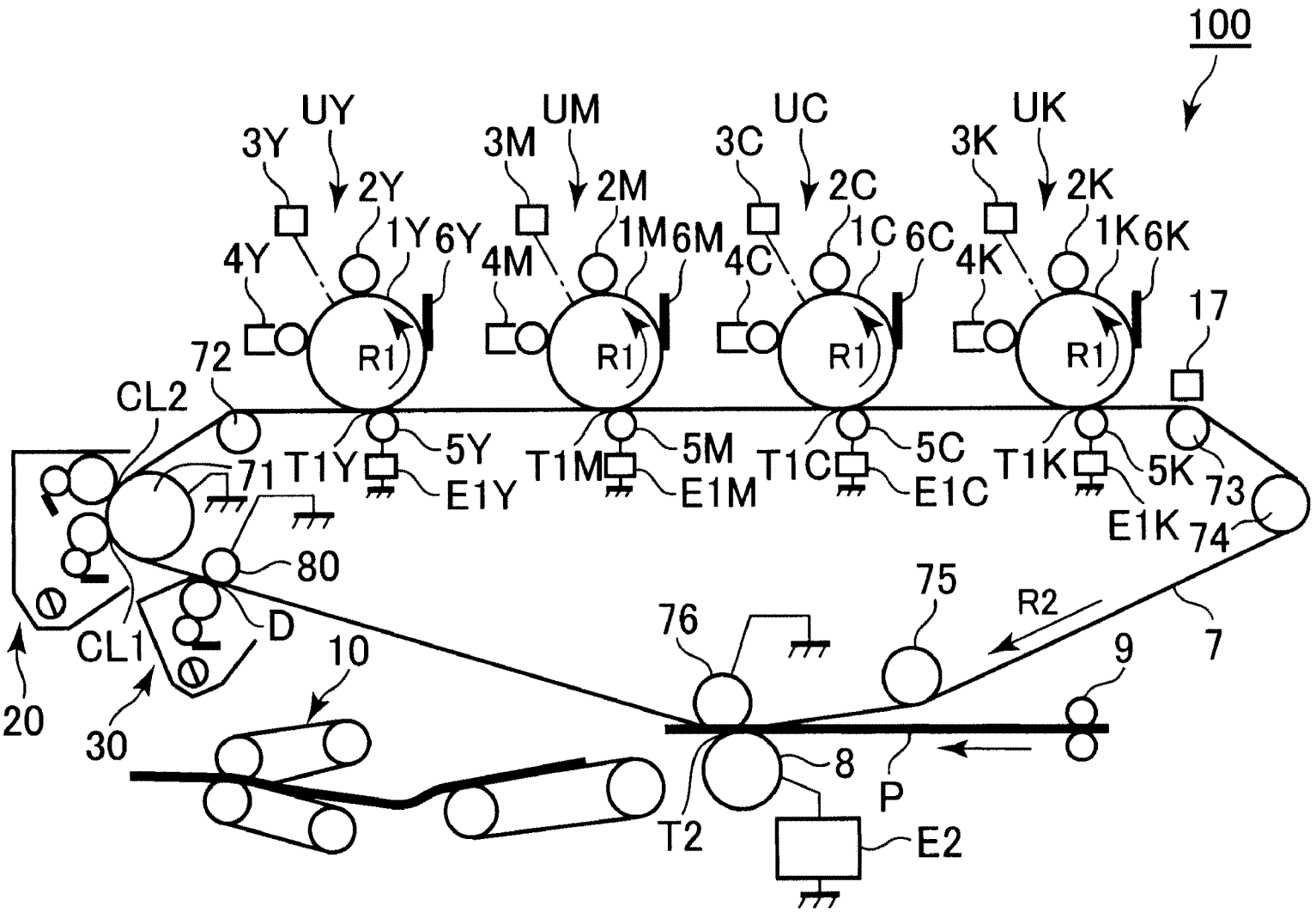
FIG. 1 is a schematic sectional view of the image forming apparatus in the first embodiment of the present invention.

FIG. 1 is a schematic sectional view of the image forming apparatus 100 in this embodiment. The image forming apparatus 100 in this embodiment is a multifunction machine (which is capable of functioning as copying machine, printing machine, and facsimileing machine) of the so-called intermediary transfer type, and also, of the so-called tandem type. It is capable of forming a full-color image with the use of one of electrophotographic image forming methods.

The image forming apparatus 100 has four image forming portions UY, UM, UC and UK which form yellow (Y), magenta (M), cyan (C) and black (K) toner images, respectively. In a case where an element of one of the image forming portion UY, UM, UC and UK is similar in structure and/or function to the counterpart in the other image formations, the suffix of the referential code for the element, for example, Y, M, C or K, which is related to the color of the monochromatic image it forms, is sometimes not shown in order to describe the four elements which are similar in structure and/or function together. In this embodiment, the image forming portion U has a photosensitive drum 1, a charge roller 2, an exposing apparatus 3, a developing apparatus 4, a primary transfer roller 5, a drum cleaning apparatus 6, etc., which are described later.

The photosensitive drum 1 is an image bearing member for bearing a toner image. It is a rotatable photosensitive member (electrophotographic photosensitive member) which is in the form of a drum. It is rotationally driven in the direction indicated by an arrow mark R1 in the drawing. As the photosensitive drum 1 is rotated, its peripheral surface is uniformly charged to preset polarity (negative in this embodiment) and potential level by the charge roller 2 which is a charging member, as a charging means, which is in the form of a roller. During the charging of the photosensitive drum 1, a preset charge bias (charge voltage) is applied to the charge roller 2. The charged peripheral surface of the photosensitive drum 1 is scanned by (exposed to) a beam of laser light emitted by an exposing apparatus 3 (laser scanner), as an exposing means, while being modulated in accordance with the information of the image to be formed. Thus, an electrostatic image (electrostatic latent image) is effected on the peripheral surface of the photosensitive drum 1. The electrostatic image formed on the photosensitive drum 1 is supplied with toner as developer by the developing apparatus 4 as a developing means. As a result, it is developed into a visible image. That is, a toner image is formed on the photosensitive drum 1. In this embodiment, such toner that is charged to the same polarity (negative in this embodiment) as the one to which the photosensitive drum 1 is charged adheres to the exposed portions (points) of the photosensitive drum 1, which have reduced (in absolute value) in potential level by being exposed in accordance with the information of the image to be formed, after being uniformly charged (reversal developing method). In this embodiment, when an electrostatic image is developed, the normal polarity of the toner is negative. Further, during the development of an electrostatic image, a preset development bias (development voltage) is applied to the development roller, as a developer bearing member, with which the developing apparatus 4 is provided.

The image forming apparatus 100 is provided with an intermediary transfer belt 7, which is an endless belt as an intermediary transferring member, and which is disposed in a manner to oppose the four photosensitive drums 1. The intermediary transfer belt 7 is suspended and tensioned by multiple rollers 71-76 by being placed in contact with the rollers in such a manner that the belt bridges between the adjacent two rollers, and also, the intermediary transfer belt 7 is provided with a preset amount of tension. As a driving roller 71, which is one of the multiple belt suspending-tensioning rollers, is rotationally driven, the intermediary transfer belt 7 rotates (circularly move in contact with rollers 71-76) in the direction indicated by an arrow mark R2 in the drawing, at a peripheral velocity of 150-470 mm/sec. A tension roller 74, which is one of the other belt suspending-tensioning rollers than the driving roller 71, continuously provide the intermediary transfer belt 7 with a preset amount of tension. A belt backing roller 76, which is another roller among the multiple belt suspending-tensioning roller functions a member (opposing electrode) which opposes a secondary transfer roller, which will be described later. Further, the image forming apparatus 100 is provided with four primary transfer rollers 5 as primary transferring members. The primary transfer rollers 5 are disposed on the inward side of the loop which the intermediary transfer belt 7 forms, in such a manner that they oppose the four photosensitive drums 1, one for one. Each primary transfer roller 5 is kept pressed against the corresponding photosensitive drum 1, with the presence of the intermediary transfer belt 7 between itself and photosensitive drum 1, forming thereby the primary transferring portion T1 (primary transfer nip), in which the photosensitive drum 1 and intermediary transfer belt 7 remain in contact with each other, between the photosensitive drum 1 and intermediary transfer belt 7. The toner image formed on the photosensitive drum 1 as described above is transferred (primary transfer) onto the intermediary transfer belt 7 by the function of the primary transfer roller 5 while the intermediary transfer belt 7 rotates. During the primary transfer, primary transfer bias, which is DC voltage and is opposite (positive in this embodiment) in polarity from the normal toner charge is applied to the primary transfer roller 5 from a primary transfer power source E1 (high voltage power source). Thus, the primary transferring portion is supplied with primary transfer current. For example, during the primary transfer, primary transfer bias, the voltage of which is kept in a range of +1-+3 KV, is applied to each primary transfer roller 5. Thus, roughly 20-60 μA of electric current is flowed through each primary transferring portion. For example, during a color image forming operation, yellow, magenta, cyan and black toner images formed on the four photosensitive drums 1, one for one, are sequentially transferred (primary transfer) onto the intermediary transfer belt 7 in such a manner that they are layered upon the intermediary transfer belt 7. In this embodiment, the primary transfer bias is applied to each primary roller 5 in synchronism with the arrival of the toner image(s) at the corresponding primary transferring portion T1.

Further, the image forming apparatus 100 is provided with the secondary transfer roller 8, which is positioned on the outward side of the loop (belt loop) which the intermediary transfer belt 7 forms, in such a manner that it opposes the aforementioned belt-backing roller 76. The secondary transfer roller 8 is a secondary transferring means, and is in the form of a roller. It is kept pressed toward the belt-backing roller 76, with the presence of the intermediary transfer belt 7 between itself and intermediary transfer belt 7. Thus, it forms the secondary transferring portion T2 (secondary transfer nip), in which the intermediary transfer belt 7 and secondary transfer roller 8 remain in contact with each other (with or without presence of sheet P of recording medium between them). The toner images formed on the intermediary transfer belt 7 as described above are transferred (secondary transfer) by the function of the secondary transfer roller 8, onto a sheet P of recording medium such as paper, in the secondary transferring portion T2, while the sheet P of recording medium is conveyed through the secondary transferring portion T2, remaining pinched by the intermediary transfer belt 7 and secondary transfer roller 8. During the secondary transfer, secondary transfer bias (secondary transfer voltage), which is such DC voltage that is opposite in polarity from the normal charge of the toner, is applied to the secondary transfer roller 8 from the secondary transfer power source E2. Thus, the secondary transferring portion T2 is supplied with the secondary transfer current. For example, during the secondary transfer, the secondary transfer bias, the voltage of which is kept in a range of roughly +1-7 KV, is applied to the secondary transfer roller 8. Therefore, roughly 40-120 μA of electric current is flowed through the secondary transferring portion T2. Sheets P of recording medium are fed one by one into the main assembly of the image forming apparatus 100 from a recording medium storage (unillustrated). Then, each sheet P is conveyed to the secondary transferring portion T2 by a pair of registration rollers 9 in synchronism with the arrival of the toner image on the intermediary transfer belt 7 at the secondary transferring portion T2. In this embodiment, the image forming apparatus 100 is provided with a secondary transfer roller moving mechanism 90 (FIG. 3) as a means for placing the secondary transfer roller 8 in contact with the intermediary transfer belt 7, or separating the secondary transfer roller 8 from the intermediary transfer belt 7. Also in this embodiment, the secondary transfer roller 8 is placed in contact with the intermediary transfer belt 7 in synchronism with the arrival of the toner image on the intermediary transfer belt 7 at the secondary transferring portion T2, and the secondary transfer bias is applied to the secondary transfer roller 8.

By the way, the belt-backing roller 76 in this embodiment may be used as the secondary transferring member. In such a case, such secondary transfer bias that is opposite in polarity from the one in this embodiment is applied to the belt-backing roller 76, and the secondary transfer roller 8 in this embodiment is grounded so that it is made to function like the belt-backing member 76 in this embodiment.

After the transfer of the toner images onto a sheet P of recording medium (paper), the sheet P is conveyed to a fixing apparatus 10 as a fixing means. The fixing apparatus 10 fixes (melts toner image so that as toner image cools, it permanently adheres to sheet P), by heating and pressing the sheet P which is bearing the unfixed toner images. After the fixation of the toner images to the sheet P, the sheet P is discharged out of (outputted from) the main assembly of the image forming apparatus 100.

Further, the toner (primary transfer residual toner) which failed to be transferred from the photosensitive drum 1 onto the intermediary transfer belt 7 during the primary transfer, and therefore, is remaining on the photosensitive drum 1, is removed from the photosensitive drum 1 by the drum cleaning apparatus 6, and is recovered by the drum cleaning apparatus 6. Further, the toner (secondary transfer residual toner) which failed to be transferred from the intermediary transfer belt 7 onto a sheet P of recording medium during the secondary transfer, and therefore, is remaining on the intermediary transfer belt 7 after the secondary transfer, is removed from the intermediary transfer belt 7 by a belt cleaning apparatus 20, as a means for cleaning the intermediary transferring member, and then, is recovered by the belt cleaning apparatus 20. The belt cleaning apparatus 20 is described later in greater detail.

In this embodiment, the primary transfer roller 5 has: a metallic core (substrative member); and an elastic layer formed of ion-conductive foamed rubber in a manner to entirely cover the peripheral surface of the metallic core. In this embodiment, the primary transfer roller 5 is 15-20 mm in external diameter. Further, it is $1\times10^5$-$1\times10^8\Omega$ in electrical resistance (measured while 2 kV is applied in N/N (23° C., 50% RH) environment).

Further, in this embodiment, the secondary transfer roller 8 has: a metallic core (substrative member); and an elastic layer formed of ion-conductive foamed rubber in a manner to entirely cover the peripheral surface of the metallic core. It is 20-25 mm in external diameter, and is $1\times10^5$-$1\times10^8\Omega$ in electrical resistance (measured while 2 kV is applied in N/N (23° C., 50% RH) environment).

Further, in this embodiment, the belt-backing roller 76 has: a metallic core (substrative member); and an elastic layer formed of ion-conductive foamed rubber in a manner to entirely cover the peripheral surface of the metallic core. It is 20-22 mm in external diameter, and is $1\times10^5$-$1\times10^8\Omega$ in electrical resistance (measured while 50 V is applied in N/N (23° C., 50% RH) environment).

Further, in this embodiment, the intermediary transfer belt 7 is a multilayer belt having a substrative layer (inward surface layer), an elastic layer (middle layer), and an outward surface layer. The substrative layer is formed of a mixture of such resin as polyimide and polycarbonate, or various rubber, and a proper amount of carbon black as a charging prevention agent. It is 0.05-0.15 [mm] in thickness. As the ion-conductive agent, aliphatic sulfonate or the like is used. The outward surface layer is formed of urethane resin, fluorine resin, or the like, and is 0.0002-0.020 [mm] in thickness. The volumetric resistivity of the intermediary transfer belt 7 is in a range of $5\times10^8$-$10\times10^{14}$ [Ω/cm] (23° C., 50% RH). The hardness of the intermediary transfer belt 7 is in a range of 60-85° (23° C., 50% RH) in MD1 hardness scale. The coefficient of static friction of the intermediary transfer belt 7 is in a range of 0.15-0.6 ((23° C., 50% RH, type 94i (product of HEIDON Co., Ltd.).

2. Belt Cleaning Apparatus

Figure 2:
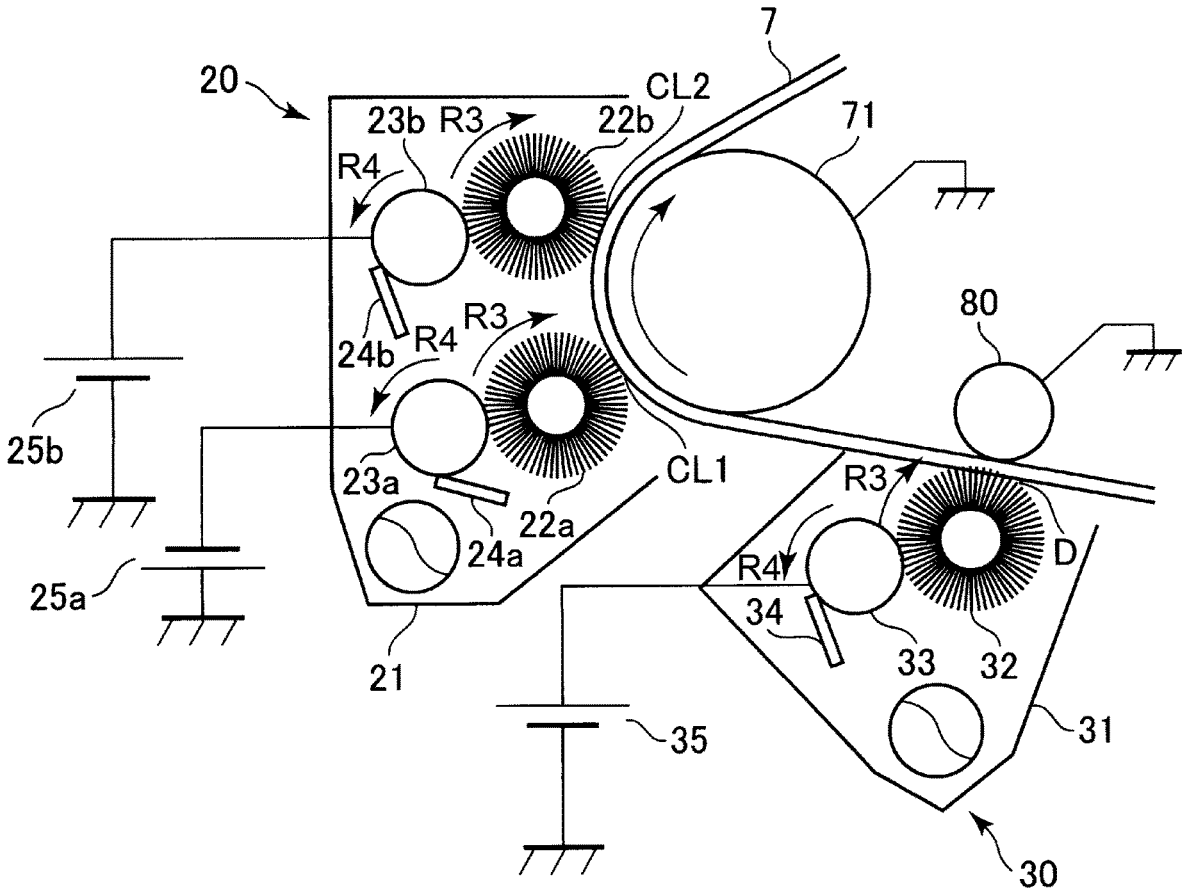
FIG. 2 is a schematic sectional view of the belt cleaning apparatus and its adjacencies in the first embodiment.

FIG. 2 is an enlarged schematic sectional view of the belt cleaning apparatus 20 in this embodiment, and its adjacencies. In terms of the rotational direction of the intermediary transfer belt 7, the belt cleaning apparatus 20 is on the downstream side of the secondary transferring portion T2, and on the upstream side of the primary transferring portion T1 (most upstream primary transferring portion T1Y). More specifically, it is positioned so that it opposes the driving roller 71 with the presence of the intermediary transfer belt 7 between itself and the driving roller 71. In this embodiment, the belt cleaning apparatus 20 is an electrostatic cleaning apparatus, which electrostatically recovers the toner on the intermediary transfer belt 7. It employs an electrically conductive fur brush roller.

In this embodiment, the belt cleaning apparatus 20 has a housing 21, which is disposed in the adjacencies of the intermediary transfer belt 7. The housing 21 contains various members of the belt cleaning apparatus 20, which will be described next. To begin with, the belt cleaning apparatus 20 has the first and second cleaning brushes 22*a* and 22*b* as the first and second cleaning members, respectively. Further, it has the first and second recovery rollers 23*a* and 23*b* as the first and second recovery members, respectively. Moreover, it has the first and second blades 24*a* and 24*b* as the first and second scraping members, respectively.

Each of the first and second cleaning brushes 22*a* and 22*b* is a rotatable and electrically conductive fur brush roller. The fiber, of which the fur brush of each of the first and second cleaning brushes 22*a* and 22*b* is made is nylon, acrylic, or polyester fiber dispersed with carbon, is $3\times10^5$-$1\times10^{13}$ (Ω/cm) in electrical resistance, and 2-15 denier in thickness. They are made by planting this fiber on a metallic roller as a substrative member, at a ratio of 50,000-500,000/inch. Further, they are positioned in contact with the intermediary transfer belt 7 in such a manner that they would intrude into the intermediary transfer belt 7 by a length of roughly 1.0-2.0 mm, if they were allowed to. Further, they are rotationally driven by a driving motor (unshown) as a driving means, at peripheral velocity which is equal to 20-80% of the peripheral velocity of the intermediary transfer belt 7, in the direction indicated by an arrow mark R3 in the drawing. That is, the first and second cleaning brushes 22*a* and 22*b* rotate in such a direction that they rotate in the opposite direction from the moving direction of the intermediary transfer belt 7, in the area of contact between them and intermediary transfer belt 7, while rubbing the outward surface of the intermediary transfer belt 7. In this embodiment, the first and second cleaning brushes 22*a* and 22*b* are kept pressed against the driving roller 71, which functions as a member (opposing electrode) which opposes them, with the presence of the intermediary transfer belt 7 between themselves and the driving roller 71. The driving roller 71 is grounded (connected to ground). The first and second cleaning brushes 22*a* and 22*b* are disposed so that their rotational axis are roughly in parallel to the widthwise direction of the intermediary transfer belt 7, which is roughly perpendicular to the moving direction of the surface of the intermediary transfer belt 7. Their dimension in terms of the direction parallel to their rotational axis is greater than the width of the widest image formable on the intermediary transfer belt 7 in terms of the widthwise direction of the intermediary transfer belt 7. The area of contact between the first cleaning brush 22*a* and intermediary transfer belt 7 is the first cleaning portion CL1 in which toner is recovered from the surface of the intermediary transfer belt 7 by the first cleaning brush 22*a*. Further, the area of contact between the second cleaning brush 22*b* and intermediary transfer belt 7 is the second cleaning portion CL2 in which toner is recovered from the surface of the intermediary transfer belt 7 by the second cleaning brush 22*b*. In terms of the rotational direction of the intermediary transfer belt 7, the first and second cleaning portions CL1 and CL2 are on the downstream side of the secondary transferring portion T2, and on the upstream side of the primary transferring portion T1 (most upstream primary transferring portion T1Y). Further, in this embodiment, in terms of the rotational direction of the intermediary transfer belt 7, the first cleaning portion CL1 is on the upstream side of the second cleaning portion CL2.

Each of the first and second recovery rollers 23*a* and 23*b* is a rotatable metallic roller (aluminum roller, in this embodiment). The first and second recovery rollers 23*a* and 23*b* are positioned so that if they were allowed to intrude into the first and second cleaning brushes 22*a* and 22*b*, respectively, they would intrude into the first and second cleaning brushes 22*a* and 22*b*, respectively, by roughly 1.5-2.5 mm. Further, the first and second recovery rollers 23*a* and 23*b* are rotationally driven by a driving motor (unshown) as a driving means, in the direction indicated by an arrow mark R4 in the drawing, at a peripheral velocity which is roughly the same peripheral velocity as the first and second cleaning brushes 22*a* and 22*b*. That is, the first and second recovery rollers 23*a* and 23*b* rotate in such a direction that they move in the same direction as the first and second cleaning brushes 22*a* and 22*b*, in the areas of contact between them and the first and second cleaning brushes 22*a* and 22*b*, respectively. The first and second recovery rollers 23*a* and 23*b* are disposed so that their rotational axes are roughly parallel to the widthwise direction of the intermediary transfer belt 7. In terms of the direction parallel to the rotational axes of the first and second recovery rollers 23*a* and 23*b*, the length of the first and second recovery rollers 23*a* and 23*b* is the same as the length of the first and second cleaning brushes 22*a* and 22*b* in terms of the direction parallel to their rotational axes.

The first and second blades 24*a* and 24*b* are disposed in contact with the first and second recovery rollers 23*a* and 23*b*, respectively. They are elastic members, and are formed of a rubbery substance such as urethane rubber. Each of the first and second blades 24*a* and 24*b* is a piece of plate, and has a preset length in terms of its lengthwise direction which is roughly parallel to the its rotational axis, and also, a preset length in terms of its widthwise direction which is roughly perpendicular to its lengthwise direction. Further, it has a preset thickness. The first and second blades 24*a* and 24*b* are 1.6-2.2 mm in thickness, 70-78° in IRHD hardness scale (23° C., 50% RH). Further, the first and second blades 24*a* and 24*b* are disposed so that if they were enabled to intrude into the first and second recovery rollers 23*a* and 23*b*, they intrude by 0.5-2.0 mm. The first and second blades 24*a* and 24*b* are placed in contact with the first and second recovery rollers 23*a* and 23*b* in such an attitude that, in terms of the rotational direction of the first and second recovery rollers 23*a* and 23*b*, their cleaning edge is on the upstream side of their base portion. The length of the first and second blades 24*a* and 24*b* in terms of the direction parallel to the rotational axis of the first and second recovery rollers 23*a* and 23*b* is the same as that of the dimension of the first and second recovery rollers 23*a* and 23*b* in terms of the direction parallel to the rotational axis of the first and second recovery rollers 23*a* and 23*b*.

In this embodiment, to the first cleaning brush 22*a*, which is on the upstream side of the second cleaning brush 22*b* in terms of the rotational direction of the intermediary transfer belt 7, negative voltage (first cleaning bias, first cleaning voltage), which is the same in polarity as the normal charge of toner, is applied. In this embodiment, as negative voltage is applied to the first recovery roller 23*a* by the first cleaning power source 25*a* (high voltage power source), negative voltage is applied to the first cleaning brush 22*a* through this first recovery roller 23*a*. In this embodiment, such negative DC voltage that is controlled so that 20 μA of current (first cleaning current) flows through the first cleaning portion CL1 is applied to the first cleaning brush 22*a* (that is, first cleaning portion CL1). Here, the current which flows from the inward surface side of the intermediary transfer belt 7 toward the outward surface side is referred to as positive current. Thus, the first cleaning current is +20 μA.

On the other hand, in this embodiment, to the second cleaning brush 22*b*, which is on the downstream side of the first cleaning brush 22*b*, positive voltage (second cleaning bias, second cleaning voltage), which is opposite in polarity from the normal charge of toner is applied. In this embodiment, positive voltage is applied to the second cleaning brush 22*b* (that is, second cleaning portion CL2) by the second cleaning power source 25*b* (high voltage power source), which is a direct current power source, so that 20 μA of current flows through the second cleaning brush 22*b*. Here, the direction (inward direction) in which current flows from the outward surface of the intermediary transfer belt 7 toward the inward surface of the intermediary transfer belt 7 is referred to the negative direction. Thus, this second cleaning current is −20 μA.

As voltage is applied to the first and second cleaning brushes 22*a* and 22*b* as described above, an electrical field (cleaning electric field) which is suitable to recover the toner on the intermediary transfer belt 7 is formed between the first and second cleaning brushes 22*a* and 22*b* and intermediary transfer belt 7. Thus, the secondary transfer residual toner on the intermediary transfer belt 7 is electrostatically adhered to the first and second cleaning brushes 22*a* and 22*b*, being thereby removed from the outward surface of the intermediary transfer belt 7. To the first cleaning brush 22*a*, positively charged toner particles in the secondary transfer residual toner on the intermediary transfer belt 7, which are opposite in polarity from the normally charged ones, adhere. To the second cleaning brush 22*b*, the negatively charged toner particles in the secondary residual toner on the intermediary transfer belt 7, that is, toner particles which are the same in polarity as the normally charged toner, adhere. Further, these toner particles on the first and second cleaning brushes 22*a* and 22*b* transfer onto the first and second recovery rollers 23*a* and 23*b* due to the presence of the electrical fields formed between the first and second recovery rollers 23*a* and 23*b* and first and second cleaning brushes 22*a* and 22*b*, respectively. Further, as these toner particles transfer onto the first and second recovery rollers 23*a* and 23*b*, they are scraped down by the first and second blades 24*a* and 24*b* from the first and second recovery rollers 23*a* and 23*b*, respectively. As they are scraped down from the first and second recovery rollers 23*a* and 23*b*, they are stored in the housing 21, and then, are conveyed further to a recovery container (unshown) by a conveying members (screws or the like).

3. Structure of Discharging Apparatus

Referring to FIG. 2, in terms of the rotational direction of the intermediary transfer belt 7, there is positioned a discharging apparatus 30 on the downstream side of the secondary transfer roller 8 (secondary transferring portion T2), and on the upstream side of the belt cleaning apparatus 20 (first and second cleaning portions CL1 and CL2). In this embodiment, the discharging apparatus 30 has the same structure as the electrostatic cleaning apparatus, in particular, an electrostatic cleaning apparatus which employs an electrically conductive fur brush.

The discharging apparatus 30 (resistance increase preventing apparatus) has a housing 31, which is disposed in the adjacencies of the intermediary transfer belt 7. The housing 31 contains the following members of the discharging apparatus 30. The first one is a discharging brush 32 as a discharging member (resistance increase preventing member). The second one is a recovery roller 33 as a recovering member. The third one is a blade 34 as a scraping member.

The discharging brush 32 is an electrically conductive fur brush roller, which is rotatable. The fiber of the discharge brush 32 is $3\times10^5$-$1\times10^{13}$ (Ω/cm) in electrical resistance, 2-15 denier in thickness. It is made of Nylon, acrylic, or polyester resin dispersed with carbon. It is made by planting this fiber on a metallic roller as a substrative member, at a ratio of 50,000-500,000/inch. Further, it is positioned in contact with the intermediary transfer belt 7 in such a manner that it would intrude into the intermediary transfer belt 7 by a length of roughly 1.0-2.0 mm, if they were allowed to. Further, it is rotationally driven by a driving motor (unshown) as a driving means, at a peripheral velocity which is equal to 20-80% of the peripheral velocity of the intermediary transfer belt 7, in the direction indicated by an arrow mark R3 in the drawing. That is, the discharging brush 32 rotates in such a direction that they rotate in the opposite direction from the moving direction of the intermediary transfer belt 7, in the area of contact between it and intermediary transfer belt 7, while rubbing the outward surface of the intermediary transfer belt 7. In this embodiment, there is disposed a belt-backing roller 80 as a member (opposing electrode, which is on the inward surface side of the intermediary transfer belt 7, being positioned in a manner to oppose the discharging brush 32. In this embodiment, the discharging brush 32 is kept pressed against the belt-backing roller 80, with the presence of the intermediary transfer belt 7 between itself and the belt-backing roller 80. The belt-backing roller 80 is grounded. The belt-backing roller 80 is disposed so that its rotational axis is roughly in parallel to the widthwise direction of the intermediary transfer belt 7. The length of the discharging brush 32 in terms of the direction which is parallel to its rotational axis is greater than the width of the largest image formable on the intermediary transfer belt 7. It is the area of contact between the discharging brush 32 and intermediary transfer belt 7 that is the discharging portion D, in which the intermediary transfer belt 7 is provided with electric current to be rectified in the ion distribution (deviation). In this embodiment, the discharging portion D is on the downstream side of the secondary transferring portion T2, and on the upstream side of the first and second cleaning portions CL1 and CL2, in terms of the rotational direction of the intermediary transfer belt 7.

The recovery roller 33 of the discharging portion D is a rotatable metallic roller (aluminum roller, in this embodiment). It is positioned so that if it were allowed to intrude into the discharging brush 32, it would intrude into the discharging brush 32, by roughly 1.5-2.5 mm. Further, the recovery roller 33 is rotationally driven by a driving motor (unshown) as a driving means, in the direction indicated by an arrow mark R4 in the drawing, at a peripheral velocity which is roughly the same peripheral velocity as the discharging brush 32. That is, the recovery roller 33 rotates in such a direction that it moves in the same direction as the discharging brush 32, in the areas of contact between it and the discharging brush 32. The recovery roller 33 is disposed so that its rotational axis is roughly parallel to the widthwise direction of the intermediary transfer belt 7. In terms of the direction parallel to the rotational axis of the recovery roller 33, the dimension of the recovery roller 33 is the same as the dimension of the discharging brush 32 in terms of the direction parallel to its rotational axis.

The blade 34 of the discharging portion is disposed in contact with the recovery roller 33 of the discharging portion D. It is an elastic member, and is formed of a rubbery substance such as urethane rubber. The blade 34 is a piece of plate, and has a preset dimension in terms of its lengthwise direction which is roughly parallel to its rotational axis, and also, a preset dimension in terms of its widthwise direction which is roughly perpendicular to its lengthwise direction. Further, it has a preset thickness. The blade 34 are 1.6-2.2 mm in thickness, 70-78° in IRHD hardness scale (23° C., 50% RH). Further, the blade 34 are disposed so that if they were enabled to intrude into the recovery roller 33, they intrude by 0.5-2.0 mm. The blade 34 is placed in contact with the recovery roller 33 in such an attitude that, in terms of the rotational direction of the recovery roller 33, its cleaning edge is on the upstream side of their base portion. The length of the blade 34 in terms of the direction parallel to the rotational axis of the recovery roller 33 is the same as that of the dimension of the recovery roller 33 in terms of the direction parallel to the rotational axis of the recovery roller 33.

In this embodiment, to the discharge brush 32, positive voltage (discharge bias, discharge voltage), which is opposite in polarity as the normal charge of toner, is applied. In this embodiment, as positive voltage is applied to the recovery roller 33 by the cleaning power source 25*a* (high voltage power source), positive voltage is applied to the discharge brush 32 through this recovery roller 33. Therefore, the discharging brush 32 (that is, discharging portion D) is provided with current for rectifying the intermediary transfer belt 7 in ion distribution (deviation). The voltage to be applied to the discharging brush 32 will be described later in detail.

(Control)

Figure 3:
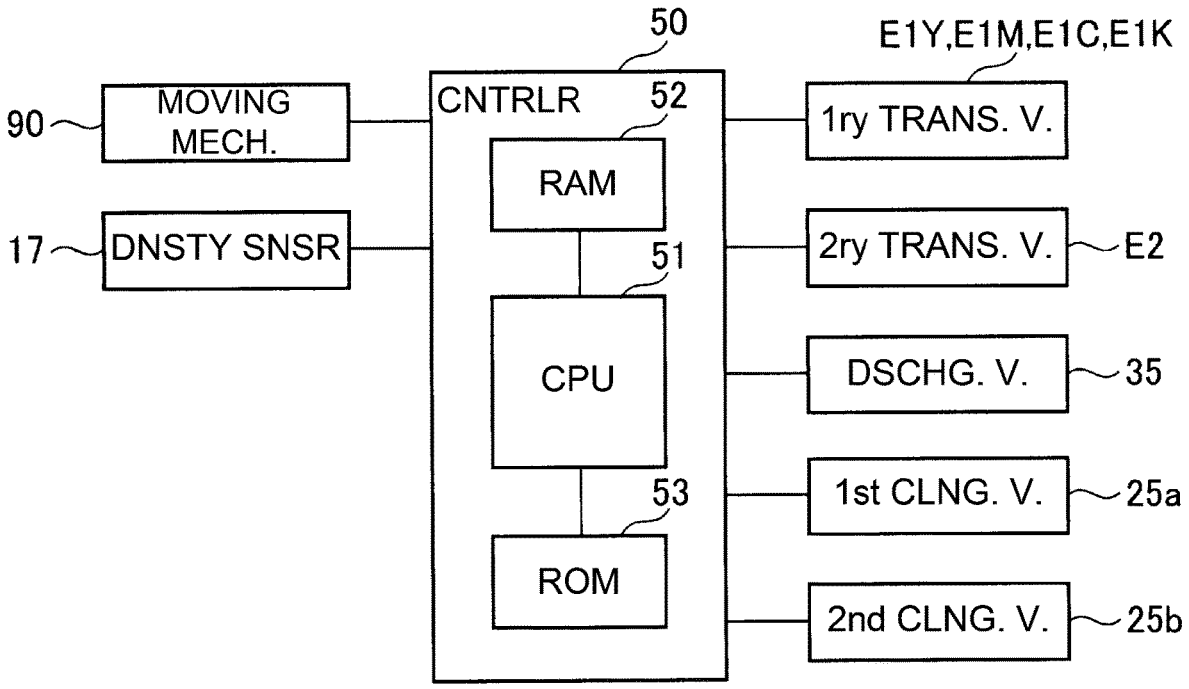
FIG. 3 is a block diagram of the essential portion of the control system of the image forming apparatus in the first embodiment.

FIG. 3 is a block diagram for showing the control of the essential portions of the image forming apparatus 100 in this embodiment. The control portion 50, as a controlling means, has: a CPU 51 as a computation controlling means which is the central processing element; memories (storing medium) such as RAM 52 and ROM 53 as storing means, etc. In the RAM 52, which is a re-writable memory, the information inputted into the control portion 50, detected information, results of computation, and the like are stored. In the ROM 53, control programs, pre-obtained data tables, etc., are stored. The image forming apparatus 100 is structured so that data can be transferred between the CPU 51 and memories such as RAM 52 and ROM 53, and also, that data can be read from the memories.

The control portion 50 is in connection to an external apparatus such as the controlling portion and image forming portion of the image forming apparatus 100, and a personal computer. It makes the image forming apparatus 100 carry out an image forming operation, by integrally controlling various portions of the image forming apparatus 100 based on the commands from the controlling portion of the image forming apparatus 100, and image data from the image reading portion, or image formation signals (image data, control commands) from the external apparatus. Shown in FIG. 3 are the primary transfer power source E1, secondary transfer power source E2, discharge power source, first and second cleaning power sources 25*a* and 25*b*, and secondary transfer roller moving mechanism 90, which represent some of the various portions of the image forming apparatus 100.

Here, the image forming apparatus 100 carries out an image forming operation (printing job), that is, an operational sequence for forming images on a single or two or more sheets P of recording medium, and outputting the sheets P out of the image forming apparatus 100, which is started in response to a single start command. Generally speaking, an image forming operation comprises: an image formation process; pre-rotation process; sheet intervals which occur when images are consecutively formed on two or more sheets P of recording medium, one for one; and post-rotation process. The image formation process corresponds to a period in which an electrostatic image of the image to be actually formed on a sheet P of recording medium is formed; a toner image is formed; the toner image is transferred (primary transfer); and the toner image is transferred (secondary transfer) onto a sheet P of recording medium. The image formation period means this period. To describe in greater detail, the formation of an electrostatic image, formation of a toner image, primary transfer of the toner image, and secondary transfer of the toner image are different in timing, depending on where these processes are carried out. They correspond to the periods in which the image formation area of the photosensitive drum 1, and the image formation area of the intermediary transfer belt 7, move through the areas where these processes are carried out. The pre-rotation period corresponds to the period between when a start command is inputted and when an image begins to be actually formed, that is, the period in which the image forming apparatus 100 is prepared for image formation prior to the starting of the image formation process. The sheet interval corresponds to the period between the two sheets P of recording medium which are consecutively conveyed when images are consecutively formed on the two sheets P of recording medium, one for one, while the two sheets P are conveyed. The post-rotation process is the process carried out after the completion of the image formation process. It corresponds to the period in which the image forming apparatus 100 is cleared (preparatory operation) for the next image forming operation. The no-image-formation period is any period in which an image is not formed. Thus, it includes various periods which correspond to the abovementioned pre-rotation period, sheet interval periods, post-rotation period. In addition, it includes the period in which the image forming apparatus 100 begins to be supplied with power, period in which the image forming apparatus 100, which is kept in the state of being asleep, is reactivated. To describe in greater detail, the no-image-formation period is equivalent to any of the periods in which the area of the peripheral surface of the photosensitive drum 1, and/or the area of the intermediary transfer belt 7, across which no image is formed, is passing through the area in which an electrostatic image is formed, area in which a toner image is formed, area in which the toner image is transferred (primary transfer) onto the intermediary transfer belt 7, and area in which the toner image is transferred (secondary transfer) onto a sheet P of recording medium. By the way, the image formation area of the peripheral surface of the photosensitive drum 1, and that of the intermediary transfer belt 7, correspond to the area in which an image to be transferred onto a sheet P of recording medium and outputted from the image forming apparatus 100 is formed. The no-image-formation area corresponds to any area which is not the image formation area. It sometimes occurs that a test toner image is formed on the no-image-formation area, as will be described later.

5. Control of Discharge Bias

<Setting of Discharge Bias> part (a) of FIG. 4 is a graph which shows an example of the relationship between the length of time voltage was applied to the intermediary transfer belt 7 (length of time voltage was supplied), and the electrical resistance of the intermediary transfer belt. Part (b) of FIG. 4 is a schematic sectional view of a measuring apparatus 200 by which the results shown in part (a) of FIG. 4 was obtained. Referring to part (b) of FIG. 4, the intermediary transfer belt 7 is placed in contact with the first roller 201 in a manner to be partially wrapped around the first roller 201, and the second roller 202 is placed in contact with the portion of the intermediary transfer belt 7, which is in contact with the first roller 201. Further, the first roller 201 is grounded. Further, positive voltage is applied to the second roller 202 from a high voltage power source 203 so that a preset amount of current flows to the second roller 202, while both the first and second rollers 201 and 202 are rotated at a preset speed. Thus, current flows in the intermediary transfer belt 7 from the outward surface side toward the inward surface side (inward) (here, current which flows inward is referred to as negative current). Referring to part (a) of FIG. 4, the intermediary transfer belt 7, which has an ion-conductive elastic layer, increases in electrical resistance by an amount which is proportional to the length of voltage application. Then, after the elapse of a preset length of time, the voltage which is being applied to the second roller 202 from the high voltage power source 203 so that the preset amount of current flows through the second roller 202 from the high voltage power source 203, is changed in polarity to the negative polarity, which is opposite from the polarity described above, and also, so that the current which flows through the second roller 202 is the same in absolute value as the positive voltage. Thus, current begins to flow (outward) from the inward surface side of the intermediary transfer belt 7 toward the outward surface side (here, current which flows outward is referred to as positive current). As the current which flows through the intermediary transfer belt 7 is changed in direction as described above, the electrical resistance of the intermediary transfer belt 7 is restored to roughly the same one as the original one, after the elapse of voltage application time which is roughly the same as the length of time the positive voltage is applied to the second roller 202 before the change.

Table 1 shows the relationship among the currents supplied to the intermediary transfer belt 7 in the aforementioned portions, one for one, during an image forming operation.

TABLE 1

| 1ry transfer current (μA) | | | | 2ry transfer current | Cleaning current | | Current balance |
|---|---|---|---|---|---|---|---|
| Y | M | C | K | (μA) | First cleaning brush | Second cleaning brush | (μA) |
| 45 | 45 | 45 | 45 | −90 | 20 | −20 | 90 |

To the intermediary transfer belt 7, current is supplied in the primary transferring portion T1 (T1Y, T1M, T1C and T1K), secondary transferring portion T2, and the first and second cleaning portions CL1 and CL2. In Table 1, the amount of the current which flows in the intermediary transfer belt 7 from the inward surface side of the intermediary transfer belt 7 toward the outward surface side (outward) is expressed in a positive (plus) value, and the amount of the current which flows in the intermediary transfer belt from the outward surface side of the intermediary transfer belt 7 toward the inward surface side is expressed in a negative (minus) value. From the sum of the current which was supplied to the intermediary transfer belt 7 in the primary transferring portion T1, the current which was supplied in the secondary transferring portion T2, and the current which was supplied in the first and second cleaning portions CL1 and CL2, is obtained from Table 1, it is evident that the outward current is greater by 90 μA than the inward current. Thus, the intermediary transfer belt 7 becomes nonuniform (unbalanced) in ion distribution. Consequently, the intermediary transfer belt 7 increases in electrical resistance.

Hereafter, the sum of the value of the current supplied to the intermediary transfer belt 7 in the primary transferring portion T1, that in the secondary transferring portion T2, that in the first and second cleaning portions CL1 and CL2 will be referred to a "current sum". In this embodiment, such positive voltage that is controlled so that 90 μA of discharge current flows through the discharging brush 32 (that is, discharging portion D) is applied to the discharging brush 32, during an image forming operation, in order to make the current sum zero. In a case where the current which flows the intermediary transfer belt 7 from the outward surface side of the intermediary transfer belt 7 toward the inward surface side (inward direction) is expressed in negative value, the amount of this discharge current is −90 μA.

By the way, the amount by which current is supplied to the discharging portion D during an image forming operation does not need to be set to the abovementioned value. This current is such current that is made to flow in the direction (inward, in this embodiment) to rectify the intermediary transfer belt 7 in its internal ion distribution. Its value has only to be no smaller than −50%, and no more than +50%, of the value that makes zero, the sum of the currents flowed through the intermediary transfer belt 7 (in this embodiment, 45 μA-135 μA). That is, this current has only to be such that its absolute value falls within 50%-150% of the absolute value of the sum of the primary transfer current, secondary transfer current, and first and second cleaning currents (that is, currents other than discharge current) that flow during an image forming operation, and also, has only to be opposite in polarity from the current sum. This requirement can be rephrased as follows. Here, the sum of the current which flows through the image formation area of the intermediary transfer belt 7 while the area is moving through the first transferring portion, current which flows through the image formation area of the intermediary transfer belt 7 while the area moves through the secondary transferring portion, and the current which flows through the image formation portion of the intermediary transfer belt 7 while the area moves through the first cleaning portion, and the current which flows though the image formation area of the intermediary transfer belt 7, during an image formation is referred to as the first current sum. That is, the first current sum is the sum of the first transfer current, second transfer current, first cleaning current, second cleaning current, and discharge current. Further, the value obtained by subtracting the discharge current from the first current balance is referred to as the second current sum. Thus, all that has to be done by the control portion is to control the power source so that the absolute value of the first current sum becomes no more than 50% of the absolute value of the second current sum.

Further, the value of this current is desired to be within ±30% of such a value that makes the current sum zero, preferably, such a value that makes the current sum roughly zero. In this embodiment, current having such a value that can make the current sum roughly zero means such current that its value is within ±5% from the value which makes the current sum zero. It is desired that the power source is controlled so that the absolute value of the first current value becomes no more than 30% of the absolute value of the second current balance, or no more than 5%. According to the studies made by the inventors of the present invention, by setting the current value as described above, it is possible to satisfactorily preventing the intermediary transfer belt 7 from increasing in electrical resistance, and therefore, it is possible to prevent the intermediary transfer belt 7 from reducing in its life expectancy due to the increase in electrical resistance. Typically, this current becomes greater in absolute value than the optimal cleaning current. If this current is such current that its value is no more than −50% of the value which can make the current sum zero, it is unsatisfactory in its effectiveness for preventing the intermediary transfer belt 7 from increasing in electrical resistance, and therefore, it becomes impossible to satisfactorily prevent the intermediary transfer belt 7 from reducing in durability. On the other hand, if this current is greater in value by no less than 50% than the value which makes the current sum zero, it is possible that ions will deviate in the opposite direction from the above described one.

By the way, if the image forming apparatus 100 in this embodiment is greater in the number by which image can be formed between when the intermediary transfer belt 7 begins to be used and when its intermediary transfer belt 7 intolerably increases in electrical resistance, than an image forming apparatus which is not provided with the discharging apparatus 30, it is reasonable to say that this embodiment is effective to prevent the intermediary transfer belt 7 from reducing in durability. However, it is desired that the image forming apparatus 100 in this embodiment is greater by 10-30% in terms of the number by which images are formable before the intermediary transfer belt 7 intolerably increases in electrical resistance than an image forming apparatus which does not have the discharging apparatus 30. The image forming apparatus 100 in this embodiment was greater by roughly 30% in terms of the number by which images were satisfactorily formable before the intermediary transfer belt 7 intolerably increased in electrical resistance than an image forming apparatus with no discharging apparatus 30.

Further, among the primary transfer biases, secondary transfer bias, first cleaning bias, second cleaning bias, and discharge bias, those that are controlled so that they generate a preset amount of current can be used so that their target current value can be used to obtain the current sum. Further, in the case of those which are controlled so that they remain stable in voltage, their target current value which are to be used for setting a target value for the voltage can be used to obtain the above described current sum. Further, in this embodiment, the value of each of the currents which are supplied to the primary transferring portion T1, secondary transferring portion T2, first and second cleaning portions CL1 and CL2, and discharging portion D, one for one, during an image forming operation is represented by the value of the current which flows the intermediary transfer belt 7 while the image formation area of the intermediary transfer belt 7 is moving through each of the abovementioned portions. Further, those portions are different in the timing (current supply timing) with which they are supplied with current during an image forming operation. For this reason or the like, it is not mandatory that the amount by which current outwardly flows through the intermediary transfer belt 7 during an image forming operation, is exactly the same as the amount by which current inwardly flows through the intermediary transfer belt 7 during an image forming operation. By setting the current to be supplied to the discharging portion D during an image forming operation as described above, it is possible to satisfactorily prevent the intermediary transfer belt 7 from increasing in electrical resistance, and therefore, it is possible to satisfactorily prevent the intermediary transfer belt 7 from being reduced in its durability.

The control portion 50 is enabled to set a value for the discharge current for each image forming operation (printing job), for example, by referring to the data table or the like which is set in advance and stored in the ROM 53. The discharge current may be set (varied) according to the type of a sheet P of recording medium which is to be used for image formation, and the environment in which the image forming apparatus 10 is used (both, or one, of temperature and humidity).

<Cleaning Performance>

Next, the belt cleaning apparatus 20 is described regarding its performance for removing the secondary transfer residual toner during an image forming operation.

FIG. 5 is a graph for describing the performance of the belt cleaning apparatus 20 regarding the removal of the secondary transfer residual toner from the intermediary transfer belt 7. Referring to FIG. 5, its horizontal axis represents the absolute value of the current to be supplied to the second cleaning brush 22*b*, and its vertical axis represents the amount of the secondary transfer residual toner on the intermediary transfer belt 7, on the downstream side of the cleaning brush 22*b* (cleaning residual toner). Referring to FIG. 5, the area of the horizontal axis, in which the amount of the secondary transfer residual toner is zero, corresponds to a current range in which cleaning apparatus is excellent in performance. By the way, the absolute value of the current to be supplied to the first cleaning brush 22*a* is set to 20 μA, which is the optimal one (optimal cleaning current) for recovering the secondary transfer residual toner, and which was obtained through the studies made in advance. Further, the cleaning performance shown in FIG. 5 was the cleaning performance of a cleaning apparatus which is not provided with the discharging apparatus 30.

Referring to FIG. 5, the cleaning apparatus 20 in this embodiment, which is structured as described above, is excellent in performance when it is set so that the current to be supplied to its cleaning brush 22*b* is 10-40 μA in absolute value. That is, in the case of the cleaning apparatus 20 in this embodiment, the optimal cleaning current is 10-40 μA. Typically, it is 20 μA. On the other hand, if the absolute value of the current to be supplied to the second cleaning brush 22*b* exceeds 40 μA, such a phenomenon occurs that the toner which has adhered to the second cleaning brush 22*b* from the intermediary transfer belt 7 adheres back onto the intermediary transfer belt 7 from the second cleaning brush 22*b*. That is, if the cleaning electric field is strong, the normally charged toner recovered by the second cleaning brush 22*b* begins to be made to revert in polarity by the electrical discharge which occurs in the second cleaning brush 22*b*, causing a re-adhesion phenomenon such as the one described above.

In this embodiment, the current to be supplied to the first cleaning brush 22*a* (first cleaning portion CL1) during an image forming operation is set to 20 μA (outward) in absolute value. Further, the current to be supplied to the second cleaning brush 22*b* (second cleaning portion CL2) during an image forming operation is set to 20 μA (inward) in absolute value.

By the way, to state in greater detail, in a case where only the second cleaning brush 22*b* is used (that is, in a case where discharging brush 32 and first cleaning brush 22*a* are not employed), the value of the cleaning current can be represented by the following one. That is, it equals the value of such second cleaning current that can minimize the amount by which toner remains on the intermediary transfer belt 7, on the downstream side of the second cleaning portion CL2, after a toner image which is largest in the amount of toner on the intermediary transfer belt 7 is transferred. The maximum amount by which toner remains on the intermediary transfer belt 7 after the primary transfer equals the maximum amount by which toner is present on the intermediary transfer belt 7 after the formation of a toner image which is the highest in toner density per unit area of the intermediary transfer belt 7 ($mg/cm^2$), on the intermediary transfer belt 7.

A phenomenon, such as the one described above, that toner is made to adhered back onto the intermediary transfer belt 7 from the second cleaning brush 22*b* occurs also to the discharging brush 32. Therefore, if the current to be supplied to the discharging brush 32 during an image forming operation is set to 90 μA in absolute value, the secondary transfer residual toner is temporarily picked up by the discharging brush 32, and then, adheres back onto the intermediary transfer belt 7, after a full rotation of the discharging brush 32 after the toner is picked up by the discharging brush 32.

Here, the first comparative image forming apparatus 100 which has the discharging apparatus 30 on the downstream side of the belt cleaning apparatus 20 in terms of the rotational direction of the intermediary transfer belt 7 as shown in part (a) of FIG. 6, and the second image forming apparatus 100 which has no discharging apparatus 30 as shown in part (b) of FIG. 6, are described. Elements of the first and second comparative image forming apparatuses 100, which are the same in functions and/or structure as the counterparts of the image forming apparatus 100 in this embodiment are given the same referential codes as those given to the counterparts. The first comparative image forming apparatus 100 is the same as the image forming apparatus 100 in this embodiment, in the setting of the currents to be supplied to the primary transferring portion T1, secondary transferring portion T2, first and second cleaning portions CL1 and CL2, and discharging portion D during an image forming operation. Further, the second comparative image forming apparatus 100 is the same as the image forming apparatus 100 in this embodiment, in the setting of the currents to be supplied to the primary transferring portion T1, secondary transferring portion T2, and first and second cleaning portions CL1 and CL2. Shown in Table 2 are changes which occurred to the performance of the first and second comparative image forming apparatuses 100, and that of the image forming apparatus 100 in this embodiment when the three image forming apparatuses 100 were subjected to an endurance test such as the following one. In the endurance tests, an image which is 5% in Duty (printing ratio) was continuously formed on sheets of ordinary paper, which were A3 in size, one for one. During the image forming operations, it was checked whether or not the image forming apparatuses failed to satisfactorily clean the intermediary transfer belt 7 across the image formation surface. In Table 2, ○ indicates that visible soiling of image did not occur; cleaning apparatus 20 was excellent in performance. Δ indicates that images were sometimes slightly soiled.

TABLE 2

| | first | 500th | 1000th |
|---|---|---|---|
| Embodiment 1 | ○ | ○ | ○ |
| Comp. example 1 | ○ | ○ | Δ |
| Comp. example 1 | ○ | ○ | ○ |

All of the image forming apparatus 100 in this embodiment, first comparative image forming apparatus 100, and second comparative image forming apparatus 100 were excellent in the cleaning performance of their belt cleaning apparatus 20 up to the 500th sheet of recording medium. In the case of the first comparative image forming apparatus 100, a phenomenon that images are slightly soiled occurred after the 1000th sheet.

Generally speaking, it is difficult to entirely (100%) remove the secondary transfer residual toner on the intermediary transfer belt 7 by the belt cleaning apparatus 20 during an image forming operation. Ordinarily, therefore, a virtually invisible amount of toner remains adhered to the intermediary transfer belt 7, on the downstream side of the belt cleaning apparatus 20 in terms of the moving direction of the intermediary transfer belt 7. In the case of the second comparative image forming apparatus 100, a member for recovering the toner which has moved through the belt cleaning apparatus 20, is not present on the downstream side of the belt cleaning apparatus 20. That is, there is no member on (in) which the toner which has moved through the belt cleaning apparatus 20 can continuously accumulate. Therefore, image defects do not occur. In the case of the second comparative image forming apparatus 100, it does not have a means for rectifying the intermediary transfer belt 7 in the ion distribution (deviation which occurs in the intermediary transfer belt 7 due to image formation). Therefore, it cannot prevent the intermediary transfer belt 7 from reducing in durability.

In the case of the structure of the first comparative image forming apparatus 100, the discharging apparatus 30 is disposed on the downstream side of the belt cleaning apparatus 20 in terms of the rotational direction of the intermediary transfer belt 7. Further, such current that is greater in absolute value than the optimal cleaning current is supplied to the discharging brush 32 during an image forming operation. Therefore, the discharging brush 32 always gradually recovers toner and stores it while always causing the re-adhesion phenomenon described above. Thus, it is reasonable to think that after the discharging brush 32 stored a certain amount of toner, the phenomenon that it causes the toner it stored, to adhere back onto the intermediary transfer belt 7, all at once with certain timing, occurred.

Further, in the case of the structure of the first comparative image forming apparatus 100, an operation for cleaning the discharging brush 32 has to be carried out with a preset frequency (for example, after images were formed for preset number of sheets of recording medium) during a continuous image forming operation. As for this operation, it is possible to carry out an operation which includes an operation which applies to the discharging brush 32, such voltage that is opposite in polarity from the one which is applied during an image forming apparatus, in order to causes the discharging brush 32 to discharge the toner which has adhered to the discharging brush 32. Causing the image forming apparatus 100 to carry out such an operation causes downtime (period in which images cannot be formed), reducing thereby the image forming apparatus 100 in productivity by an amount which is proportional to the length of time necessary for this operation. Further, in such a case as a jam (paper jam) occurs, and therefore, toner which failed to be transferred onto a sheet of recording medium is remaining on the intermediary transfer belt 7, it is difficult to clean the intermediary transfer belt 7 by activating the belt cleaning apparatus 20 only once. Therefore, a substantial amount of toner arrives all at once at the discharging apparatus 30, which is on the downstream side of the belt cleaning apparatus 20. Also in this case, an extra length of time is necessary for the operation for removing the toner on (and/or in) the discharge brush 32. That is, it takes an extra length of time for the image forming apparatus 100 to recover after the jam. By the way, it is reasonable to provide the image forming apparatus 100 with a mechanism for placing the discharging brush 32 in contact with, or separate from, the intermediary transfer belt 7, in order to prevent the toner, which failed to be transferred onto a sheet of recording medium, from adhering to the discharging brush 32. Such a structural arrangement, however, complicates the apparatus 100.

In comparison, in this embodiment, the discharging apparatus 30 is disposed on the downstream side of the secondary transfer roller 8 (secondary transferring portion T2), and on the upstream side of the belt cleaning apparatus 20 (first and second cleaning portions CL1 and CL2). Further, such discharge current that makes the intermediary transfer belt 7 zero in current sum, is applied to the discharging portion D during an image forming operation. By supplying the discharging portion D with such current, it is possible to rectify the intermediary transfer belt 7 in its internal ion distribution (deviation), and therefore, it is possible to prevent the intermediary transfer belt 7 from increasing in electrical resistance. Therefore, it is possible to make the intermediary transfer belt 7 last longer. Further, as the discharging portion D is supplied with such discharge current as the one described above, the positively charged toner on the intermediary transfer belt 7, that is, the toner which is likely to adhere back onto the intermediary transfer belt 7 from the discharging brush 32, can be recovered by the first cleaning brush 22*a*. That is, even if the operation for cleaning the discharging brush 32 is not carried out, the positively charged toner, that is, the toner which is likely to adhere back onto the intermediary transfer belt 7 from the discharging brush 32, is recovered by the first cleaning brush 22*a*. Also in this embodiment, it is possible to recover the negatively charged secondary transfer residual toner, that is, the toner which failed to be recovered by the discharging brush 32, by the second cleaning brush 22*b*. As described above, in this embodiment, the intermediary transfer belt 7 is rectified in its internal ion distribution (deviation) to prevent the intermediary transfer belt 7 from increasing in electrical resistance, during an image forming operation. Therefore, it does not occur that the image forming apparatus 100 is reduced in productivity because of the downtime which occurs to clean the discharging brush 32.

<Sequence>

Next, the operational sequences which are to be carried out by various portions of the image forming apparatus 100 in this embodiment during an image forming operation are described.

FIG. 7 is a timing chart which shows the timing with which the operational sequences to be carried out by various portions of the image forming apparatus 100 in this embodiment are carried out. Shown in this drawing are the operational sequences to be carried out by the various portion of the image forming apparatus 100. Shown at the top is the timing with which the intermediary transfer belt 7 is turned on/off. The second is the timing with which the primary transfer bias is turned on/off. The third is the timing with which the secondary transfer roller 8 is placed in contact with, or separated from, the intermediary transfer belt 7 (secondary transfer bias is turned on/off). The fourth is the timing with which the means for driving the discharge roller 32 is turned on/off (discharge bias is turned on/off). The fifth is the timing with which the means for driving the first and second cleaning brushes 22*a* and 22*b* is turned on/off (first and second cleaning biases are turned on/off). By the way, for convenience sake, it is assumed that the first transfer bias remains turned on from when it is turned on in the most upstream image forming portion UY until when it is turned off in the most downstream image forming portion YK.

As an image forming operation (printing job) is started, the driving of the intermediary transfer belt 7 is started (t1). At this point in time, the driving of each photosensitive drum 1 is also started. Next, the driving of the first and second cleaning brushes 22*a* and 22*b*, and the application of the first and second cleaning bias are started at practically the same time (t2). Further, the driving of the discharging brush 32 and the application of the discharge bias are started with practically the same timing as, or a preset satisfactorily short length of time after the timing t2 (t3). By the way, although it depends on the positional relationship between the discharging brush 32 and the first and second cleaning brushes 22*a* and 22*b*, the timing with which the first and second cleaning biases begin to be applied is desired to be set as follows. That is, it is desired that the application of the first and second cleaning biases is started at least the portion of the intermediary transfer belt 7, which was in the discharging portion D when the intermediary transfer belt 7 was stationary, reaches the first cleaning portion CL1. With the first and second biases started as described above, it is better ensured that the toner which will be possibly adhered back onto the intermediary transfer belt 7 from the discharging brush 32 due to the shocks which occur as the intermediary transfer belt 7 begins to be rotated. Next, the application of the charge bias, development bias, primary transfer bias, and the like are started in synchronism with the arrival of the portion of the intermediary transfer belt 7, to which the cleaning bias and discharge bias were applied, at the primary transferring portion T1 (t4). Next, as soon as the image forming apparatus 100 becomes ready for image formation, a toner image is formed on each photosensitive drum 1, and the formed toner images are transferred (primary transfer) onto the intermediary transfer belt 7. Then, after the completion of the transfer (primary transfer) of toner images onto the intermediary transfer belt 7, the secondary transfer roller 8 is placed in contact with the intermediary transfer belt 7, and the application of the secondary transfer bias is started, in synchronism with the arrival of the toner images on the intermediary transfer belt 7 at the secondary transferring portion T2 (t5).

After the completion of the primary transfer of a toner image onto the intermediary transfer belt 7, the application of the primary transfer bias is ended (t6). Further, after the completion of the secondary transfer of the toner image (image formation on recording medium), the secondary transfer roller 8 is separated from the intermediary transfer belt 7, and the application of the secondary transfer bias is ended (t7). Then, after the completion of the removal of the secondary transfer residual toner by the belt cleaning apparatus 20, the driving of the discharging brush 32 and the application of the discharge bias are ended (t8). Further, at practically the same time as this, or slightly after this, the driving of the first and second cleaning brushes 22*a* and 22*b*, and the application of the first and second cleaning biases are ended (t9). Then, the driving of the intermediary transfer belt 7 is stopped (t1), ending the image forming operation.

As described above, according to this embodiment, the intermediary transfer belt 7 is rectified in its internal ion distribution (deviation) to prevent the intermediary transfer belt 7 from increasing in electrical resistance. Therefore, it is possible to prevent the image forming apparatus 100 from being reduced in productivity by the cleaning of the discharging brush 32.

Embodiment 2

Next, another embodiment of the present invention is described. The image forming apparatus in this embodiment is the same in basic structure and operation as the one in the first embodiment. Therefore, the elements of this image forming apparatus, which are the same as, and/or correspondent to, the counterparts of the one in the first embodiment, are given the same referential code as the counterparts, and are not described in detail.

In this embodiment, the discharge bias applied while a test toner image formed across the no-image-formation area of the intermediary transfer belt 7 is moving through the discharging portion D is made different from the discharge bias applied while the no-image-formation area of the intermediary transfer belt 7 having no test image is moving through the discharging portion D.

1. Density Control

The image forming apparatus 100 sometimes changes in image density due to its ambience and/or elapse of time. In this embodiment, therefore, the image forming apparatus 100 is designed so that it can be adjusted (control mode) in the maximum image density (toner density of solid image) after the outputting of a preset number of prints (after Nth print) during an image forming operation.

Next, referring to FIGS. 3, and 8-10, the density control in this embodiment is described. FIG. 8 is a schematic drawing for showing the positioning of the patterned images for the density control. FIG. 9 is a flowchart for showing the general procedure of the density control in this embodiment. FIG. 10 is a graph for showing the relationship between the signal values and potential level, during the density control.

As the density control is started (S100), the secondary transfer roller 8 is separated from the intermediary transfer belt 7. Then, two patterned images 77 (test toner images), which are N1 and N2 in density, are formed, with development contrast set at V1 and V2 (FIG. 10), which sandwiches the development contrast V0 which corresponds to the target density stored in the ROM 53 during the preceding control (S101). The patterned images 77 are in the form of a 25 mm×25 mm square. They are formed on the photosensitive drum 1 at densities N1 and N2, respectively, and are transferred (primary transfer) onto the intermediary transfer belt 7. They are formed so that they fall within the area of the intermediary transfer belt 7, which corresponds to the largest image formable on the intermediary transfer belt 7 in terms of the widthwise direction of the intermediary transfer belt 7.

The image forming apparatus 100 is provided with a density sensor 17 as a density detecting means for detecting the density of a toner image on the intermediary transfer belt 7 (FIG. 1). The density sensor 17 is positioned so that it can detect the density of the toner image on the intermediary transfer belt 7, on the downstream side of the primary transferring portion T1K, that is, the most downstream one, and on the upstream side of the secondary transferring portion T2, in terms of the rotational direction of the intermediary transfer belt 7. There are disposed a light emitting element (unshown) and a light sensing element (unshown) in the density sensor 17. The density sensor 17 sheds light upon the patterned images N1 and N2, and detects the reflection of the light. Then, it inputs the output values Q1 and Q2, which correspond to the optical densities of the two patterned images, into the CPU 51, which temporarily stores the inputted output values Q1 and Q2 in the RAM 52 (S102).

In this embodiment, data which was organized in advance so that in a case where the image forming apparatus 100 becomes zero in the image density measured with the use of an X-rite reflective density gauge, 0 is stored in the ROM 53 (Q=0), and also, so that in a case where it becomes 1.5 in the same image density, 255 is stored in advance in the ROM 53 (Q=255). From the detected signal values Q1 and Q2 obtained by detecting a patterned image 77 with the use of a density sensor 17, the development contrast Vt which corresponds to the target density signal value Qt is computed by the CPU 50 by linear interpolation (S103). For example, assuming here that the maximum target density is 1.2, and the current development contrast which corresponds to this density is 200 V, if the image forming apparatus 100 in this embodiment is such an apparatus that as it changes by 20 V in development contrast, it changes 0.1 in the density of the adjacencies of solid portions of an image, the patterned image is outputted at a level which equals the current contrast ±20 V. That is, the patterned images 77 are formed at development contrast 160 V (V1), which results in a density of roughly 1.0 (N1), and also, at a development contrast of 240 V (V2) which results in a density of roughly 1.4 (N2), and the resultant images are detected by the density sensor 17. It is assumed here that the detected signals Q1 and Q2 are 175 (Q=175), 245 (Q=245), respectively. In this case, a new development contrast Vt is obtained from the obtained two signal values by linear interpolation, and replaces the current development contrast V0 in the ROM 53 with the new development contrast Vt (S104). Then, the patterned images 77 are conveyed to the discharging portion D and the first and second cleaning portions CL1 and CL2, without being transferred. Then, the patterned images 77 are recovered by the belt cleaning apparatus 20, and the density control (adjustment) is ended. Then, the image forming apparatus 100 is put back to the normal operation to form the next image (S105).

2. Control of Discharge Bias

<Setting of Discharge Bias>

Also in this embodiment, the discharging portion D is supplied with the same discharge current (90 μA of inward current) as the one in the first embodiment, during the density control, which includes the period in which the test toner image formed on the no-image-formation area of the intermediary transfer belt 7 is moving through the discharging portion D. By the way, the setting of the current to be supplied to the primary transferring portion T1, secondary transferring portion T2, and first and second cleaning portions CL1 and CL2 during an image forming operation, in this embodiment, are the same as those in the first embodiment.

Next, the discharge bias to be applied to the discharging portion D when the test toner image on the intermediary transfer belt is moving through the discharging portion D is described.

Also in this embodiment, a test toner image (patterned image for density control) is formed on the intermediary transfer belt 7 of the image forming apparatus 100 as described above, and the density of this toner image is detected to control the image forming apparatus 100 in image density. The image forming apparatus 100 is structured so that while the test toner image is moving though the secondary transferring portion T2, the secondary transfer roller 8 is kept separated from the intermediary transfer belt 7. Therefore, practically the entirety of the test toner image reaches the discharging portion D, and then, the first and second cleaning portions CL1 and CL2, in which it is recovered by the belt cleaning apparatus 20. The test toner image is greater in the amount of toner than the residual toner image which results from a normal toner image formed on the image formation area of the intermediary transfer belt 7. In this embodiment, the amount of toner of the secondary transfer residual toner image is roughly 0.05 mg/cm$^2$. In comparison, the amount of toner of the test toner image (which is not transferred) is roughly 0.45 mg/cm$^2$, which is equal to the maximum amount by which toner is adhered to the intermediary transfer belt 7 by the image forming apparatus 100.

FIG. 11 is a graph which is similar to FIG. 5, and which is for describing the belt cleaning apparatus 20 about its performance in terms of the removal of the test toner image. The horizontal axis represents the amount (in absolute value) of current to be supplied to the second cleaning brush 22*b*, and the vertical axis represents the amount of the toner remaining on the intermediary transfer belt 7 after the moving of the test toner image through the second cleaning brush 22*b* (amount by which toner remains on intermediary transfer belt 7 after cleaning of intermediary transfer belt by second cleaning brush 22*b*). The solid line in FIG. 11 represents the performance of the belt cleaning apparatus 20, regarding the removal of the secondary transfer residual toner, shown in FIG. 5. The broken line represents the cleaning performance of the belt cleaning apparatus 20 regarding the removal of the test toner image. By the way, the current to be supplied to the first cleaning brush 22*a* is fixed to 20 μA (absolute value). Further, the cleaning performance shown in FIG. 11 was obtained with the use of a belt cleaning apparatus which is not provided with the discharging apparatus 30.

As is indicated by the broken line in FIG. 11, a single full rotation of the intermediary transfer belt 7 is not enough for the toner image on the intermediary transfer belt 7 to be completely removed by the second cleaning brush 22*b*. Further, if the belt cleaning apparatus 20 is provided with the discharging apparatus 30, and the discharging portion D is provided with discharge current (90 μA of inward current) which is similar to the one which is to be supplied thereto while the secondary transfer residual toner resulting from an ordinary image is moving through the discharging portion D, the following phenomenon occurs. That is, the discharging brush 32 temporarily takes up most of the test toner image, and then, returns to (adheres back onto) the intermediary transfer belt 7.

FIG. 12 is a graph which shows the distributions of the amount of toner charge across the test toner image when the image forming apparatus 100 is in the following states, that is, the state prior to the arrival of the test toner image at the discharging portion D, state between when the test toner image comes out of the discharging portion D and when it reaches the first cleaning portion CL1, and state between when it comes out of the first cleaning portion CL1 and when it reaches the second cleaning portion CL2. The horizontal axis represents the amount of toner charge of the test toner image on the intermediary transfer belt 7, per unit area (Q/M (q/cm$^2$), and the vertical axis represents the amount of toner (referential amount). Part (a) of FIG. 12 shows the distribution of the amount of toner charge when the discharging portion D was provided with 90 μA of inward current, and part (b) of FIG. 12 shows the distribution of the amount of toner charge when the discharging portion D was provided with 10 μA of inward current. By the way, the first cleaning portion CL1 was provided with the same first cleaning current (20 μA of outward current) as the one in the first embodiment.

It is evident from part (a) of FIG. 12 that in a case where the discharging portion D was provided with 90 μA of inward current while the test toner image was moving through the discharging portion D, the toner was reversed in polarity, becoming positive in charge, by being subjected to the discharge current in the discharging brush 32. This toner adhered back onto the intermediary transfer belt 7, and reached the first cleaning portion CL1. After it moved through the first cleaning portion CL1, the toner particles which were full of positive charge were recovered by the first cleaning brush 22*a*, whereas the toner particles which were negatively charged (less in positive charge) remained on the intermediary transfer belt 7. However, on the downstream side of the first cleaning portion CL1, in terms of the rotational direction of the intermediary transfer belt 7, not only negatively charged toner particles, but also, a relatively large amount of toner particles which are close to zero in the amount of electrical charge, were present on the intermediary transfer belt 7. These toner particles which are close to zero in the amount of electrical charge cannot be recovered by the second cleaning brush 22*b*. Therefore, they are likely to adhere to the image which is going to be formed next, making it possible for the image forming apparatus 100 to output defective images.

On the other hand, it is evident from part (b) of FIG. 12 that in a case where the discharging portion D was provided with 10 μA of inward current while the test toner image was moving through the discharging portion D, most of the toner did not become positive in polarity by being subjected to the discharge current in the discharge brush 32. Therefore, on the downstream side of the first cleaning portion CL1, in terms of the rotational direction of the intermediary transfer belt 7, there was relatively small amount of toner particles which were close to zero in the amount of electrical charge on the intermediary transfer belt 7. Therefore, it was possible to satisfactorily recover the toner of the test toner image, making it possible to prevent the image forming apparatus 100 from outputting defective images.

In this embodiment, the amount of the current to be supplied to the first cleaning brush 22*a* (first cleaning portion CL1) during an image forming operation is fixed to 20 μA (outward) in absolute value, like in the first embodiment. Also in this embodiment, the amount of the current to be supplied to the second cleaning brush 22*b* (second cleaning portion CL2) during an image forming operation is fixed to 20 μA (inward) in absolute value, like in the first embodiment.

By the way, it is not mandatory that the amount of the current to be supplied to the discharging portion D while the test toner image is moving through the discharging portion D is set to aforementioned one. All that is necessary is that the value of the discharge current supplied while the area of the intermediary transfer belt 7, which has the test toner image, is moving through the discharging portion D, is smaller in absolute value than the value of the discharge current applied discharging portion D while the area of the intermediary transfer belt 7, which has the residual toner, is moving through the discharging portion D. Typically, the value of the discharge current to be supplied while the area of the intermediary transfer belt 7, which has the test toner image, is moving through the discharging portion D is set to be smaller in absolute value than the value of the second cleaning current supplied while the area of the intermediary transfer belt 7, which has the test toner image, is moving through the second cleaning portion CL2. Setting these values as described above makes it possible to prevent the electrical charge of the toner of the test toner image from being reversed in polarity by the discharging brush 32, and therefore, the toner of the test toner image can be satisfactorily recovered by the belt cleaning apparatus 20. In this embodiment, this current is such current that is directed (inward, in this embodiment) to rectify the intermediary transfer belt 7 in its internal ion distribution (deviation), and is set to be less in absolute value than the optimal cleaning current. Setting these current to the values described above prevents the electrical charge of the toner of the test toner image from reversing in polarity, and also, is more or less effective to rectify the intermediary transfer belt 7 in its internal ion distribution (deviation) attributable to the discharge current, even while the test toner image is moving through the discharging portion D. However, the amount of the current to be supplied to the discharging portion D while the test toner image is moving through the discharging portion D may be set to be zero or negative.

<Sequence>

Next, each portion of the image forming apparatus in this embodiment is described about its operational sequence. In this embodiment, the image forming apparatus 100 is controlled in image density during a sheet interval during an image forming operation.

FIG. 13 is a timing chart of the operational sequence of each portion of the image forming apparatus 100 in this embodiment. It shows the timing of the operational sequence of each portion of the image forming apparatus 100, like FIG. 7.

As an image forming operation (printing job) is started, the driving of the intermediary transfer belt 7 is started (t1). At this point in time, the driving of each photosensitive drum 1 is also started. Next, the driving of the first and second cleaning brushes 22*a* and 22*b*, and the application of the first and second cleaning biases are started at practically the same time (t2). Further, the driving of the discharging brush 32 and the application of the discharge bias are started with practically the same timing t2 as, or a preset satisfactorily short length of time after the timing t2 (t3). At this point in time, the discharge bias is applied while being controlled so that it causes 90 μA of current to flow inward in the discharging portion D. By the way, the timing with which the first and second cleaning biases begin to be applied is desired to be the same as the one mentioned in the description of the first embodiment. Next, the application of the charge bias, development bias, primary transfer bias, and the like are started in synchronism with the arrival of the portion of the intermediary transfer belt 7, to which the cleaning bias and discharge bias were applied, at the primary transferring portion T1 (t4). Next, as soon as the image forming apparatus 100 becomes ready for image formation, a toner image is formed on each photosensitive drum 1, and the formed toner images are transferred (primary transfer) onto the intermediary transfer belt 7. Then, after the completion of the transfer (primary transfer) of toner images onto the intermediary transfer belt 7, the secondary transfer roller 8 is placed in contact with the intermediary transfer belt 7, and the application of the secondary transfer bias is started, in synchronism with the arrival of the toner images on the intermediary transfer belt 7 at the secondary transferring portion T2 (t5).

In this embodiment, the density control sequence is carried out for every preset number of images formed, during an image forming operation. As the density control sequence is started, the secondary transfer roller 8 is quickly separated from the intermediary transfer belt 7 after the completion of the secondary transfer of the last image formed before the starting of the density control sequence (t6). Then, the test toner image is formed on the no-image-formation area (sheet interval portion) of the intermediary transfer belt 7, and the density of this test toner image is detected by the density sensor 17 to control the image forming apparatus 100 in image density. Further, before this test toner image reaches the discharging portion D, the target current value for the discharge bias is changed from 90 μA to 10 μA (t7). That is, the discharge bias is controlled so that 10 μA of current flows inward through the discharging portion D. This timing for this change is optional, but, is desired to be after the secondary residual toner from the last image formed before the starting of the density control sequence moved out of the discharging portion D, and before the test toner image reaches the discharging portion D. Thereafter, the target value for the current to be flowed by the discharge bias is changed from 10 μA to 90 μA before the secondary transfer residual toner from the next image reaches the discharging portion D (t8). The timing for this change is desired to be after the test toner image moved out of the discharging portion D, and before the secondary transfer residual toner from the first image formed after the completion of the density control sequence reaches the discharging portion D. This timing is optional. In this embodiment, the target value for the current to be flowed by the discharge bias is quickly changed after the passing of the test toner image through the discharging portion D. Then, in synchronism with the arrival of the first image formed after the completion of the density control sequence at the secondary transferring portion T2, the secondary transfer roller 8 is placed in contact with the intermediary transfer belt 7, and the application of the secondary transfer bias is started (t9).

Then, after the completion of the transfer (primary transfer) of a toner image onto the intermediary transfer belt 7, the application of the primary transfer bias is ended (t10). Further, after the completion of the transfer (secondary transfer) (image formation) of the toner image onto a sheet P of recording medium, the secondary transfer roller 8 is separated from the intermediary transfer belt 7, and the application of the secondary transfer bias is ended (t11). Then, the removal of the secondary transfer residual toner by the belt cleaning apparatus 20 is ended, and the driving of the discharging brush 32 and application of the discharge bias are ended (t12). Further, at practically the same time as, or slightly later than, the completion of the preceding steps t12, the driving of the first and second cleaning brushes 22*a* and 22*b* and the application of the first and second biases are ended (t13). Then, the driving of the intermediary transfer belt 7 is ended (t14), ending the image forming operation.

As described above, in this embodiment, while the test toner image (pre-transfer toner) is moving through the discharging portion D during an image forming operation, the discharging portion D is supplied with such current that is smaller in absolute value than the optimal cleaning current. With this procedure, not only it is possible to obtain the same effects as those in the first embodiment, but also, it is possible to prevent the belt cleaning apparatus 20 from being reduced in performance regarding the removal of the test toner image.

Embodiment 3

Next, another embodiment of the present invention is described. In terms of basic structure and function, the image forming apparatus in this embodiment is the same as the image forming apparatus in the first embodiment. Therefore, the elements of this image forming apparatus, which are the same as, and/or correspondent to, the counterparts of the one in the first embodiment, are given the same referential code as the counterparts, and are not described in detail.

This embodiment is different from the first embodiment in the positioning of the first and second cleaning brushes 22*a* and 22*b* and discharging brush 32.

FIG. 14 is an enlarged schematic sectional view of the belt cleaning apparatus 20 and discharging apparatus 30, and their adjacencies. Also in this embodiment, the belt cleaning apparatus 20 is provided with the first and second cleaning brushes 22*a* and 22*b* and the first and second recovery rollers 23*a* and 23*b*, as in the first embodiment. Further, the discharging apparatus 30 is provided with discharging brush 32, recovery roller 33, and blade 34, as in the first embodiment. These members share the same housing 81. Further, in this embodiment, the first cleaning brush 22*a* (first cleaning portion CL1) is disposed on the downstream side of the second cleaning brush 22*b* (second cleaning portion CL2) in terms of the rotational direction of the intermediary transfer belt 7. By the way, also in this embodiment, the first and second cleaning portions CL1 and CL2 are disposed on the downstream side of the secondary transferring portion T2, and on the upstream side of the primary transferring portion T1 (most upstream primary transferring portion T1Y) in terms of the rotational direction of the intermediary transfer belt 7. In this embodiment, however, the belt-backing roller 80 is positioned in a manner to oppose the second cleaning brush 22*b* with the presence of the intermediary transfer belt 7 between itself and the second cleaning brush 22*b*.

Further, in this embodiment, the discharging brush 32 (discharging portion D) is disposed on the upstream side of the first cleaning brush 22*a* (first cleaning portion CL1) and on the downstream side of the second cleaning brush 22*b* (second cleaning portion CL2) in terms of the rotational direction of the intermediary transfer belt 7.

Also in this embodiment, DC voltage is applied to the discharge brush 32 while being controlled so that 90 μA of DC current flows inward through the discharging portion D, during an image forming operation, as in the first embodiment. Further, DC voltage is applied to the first cleaning brush 22*a* while being controlled so that 20 μA of DC current flows outward through the first cleaning portion CL1, during an image forming operation, as in the first embodiment. Further, DC voltage is applied to the second cleaning brush 22*b* while being controlled so that 20 μA of DC current flows inward through the second cleaning portion CL2, during an image forming operation, as in the first embodiment.

As described above, the discharging brush 32 is disposed at least on the downstream side of the secondary transfer roller 8 (secondary transferring portion T2), and on the upstream side of the first cleaning brush 22*a* (first cleaning portion CL1), in terms of the rotational direction of the intermediary transfer belt 7. Therefore, the positively charged toner, which adhered back onto to the intermediary transfer belt 7 from the discharging brush 32, can be recovered by the first cleaning brush 22*a*. Further, in this embodiment, the negatively charged secondary transfer residual toner, which was not recovered by the second cleaning brush 22*b*, is reversed in polarity by the discharging brush 32, and adheres back onto to the intermediary transfer belt 7, being enabled to be recovered by the first cleaning brush 22*a*. That is, according to this embodiment, it is possible to rectify the intermediary transfer belt 7 in internal ion distribution (deviation) to prevent the intermediary transferring member from increasing in electrical resistance. Therefore, it is possible to prevent the problem that the image forming apparatus 100 is reduced in productivity because of the cleaning of the discharging brush 32.

By the way, also in this embodiment, the discharging portion D may be supplied with such inward current that is smaller in absolute value than the optimal cleaning current, while the area of the intermediary transfer belt 7, which is bearing the test toner image, is moving through the discharging portion D, as in the second embodiment. According to the present invention, it is possible to prevent the intermediary transferring member from increasing in electrical resistance. Therefore, it is possible to prevent the problem that an image forming apparatus is reduced in productivity, because of the cleaning of its member for supplying the intermediary transferring member with current.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-160681 filed on Aug. 29, 2018, which is hereby incorporated by reference herein in its entirety.

What is claimed is:

1. An image forming apparatus comprising:

an image bearing member configured to carry a toner image;

an intermediary transfer belt configured to receive the toner image from said image bearing member;

a primary transfer member provided in contact with said intermediary transfer belt at a primary transfer position and configured to primary-transfer the toner image from said image bearing member onto said intermediary transfer belt by supplying a primary transferring current to said intermediary transfer belt;

a secondary transfer member provided in contact with said intermediary transfer belt at a secondary transfer position and configured to secondary-transfer the toner image from said intermediary transfer belt onto the recording material by supplying a secondary-transfer current to said intermediary transfer belt;

a first cleaning member provided in contact with said intermediary transfer belt at a first cleaning position downstream of said secondary transfer position and upstream of said primary transfer position in a rotational moving direction of said intermediary transfer belt, said first cleaning member being configured to collect the toner charged to a polarity opposit to a regular polarity from said intermediary transfer belt with a first cleaning current flowing between said intermediary transfer belt and said first cleaning member;

a second cleaning member provided in contact with said intermediary transfer belt and a second cleaning position downstream of said secondary transfer position and the upstream of said primary transfer position in the rotational moving direction of said intermediary transfer belt, said second cleaning member being configured to collect the toner charged to the regular polarity from said intermediary transfer belt with a second cleaning current flowing between said intermediary transfer belt and said second cleaning member; and a discharge member provided in contact with said intermediary transfer belt at a discharging position downstream of said secondary transfer position and upstream of said first cleaning position in the rotational moving direction of said intermediary transfer belt, said discharge member being configured to collect the toner charged to the regular polarity from said intermediary transfer belt and discharged said intermediary transfer belt with a discharge current flowing between said intermediary transfer belt and said discharge member, wherein an absolute value of the discharge current at the time when an image area of said intermediary transfer belt on which the toner image to be transferred to the recording material is formed passes the discharge position is larger than an absolute value of the second cleaning current at the time when the image area of said intermediary transfer belt passes the second cleaning position, and wherein an absolute value of a first current balance is not more than 50% of an absolute value of a second current balance, wherein the first current balance is a sum of the primary transferring current, the secondary-transfer current, the first cleaning current, the second cleaning current, and the discharge current at the time when the image area of said intermediary transfer belt passes the primary transfer position, the secondary transfer position, the first cleaning position, the second cleaning position, and the discharge position, respectively, and the second current balance is the first current balance minus the discharge current at the time when the image area of said intermediary transfer belt passes the discharge position, when a current flowing in a direction from an inner surface side toward an outer peripheral surface side of said intermediary transfer belt is taken as positive current.

2. An apparatus according to claim 1, wherein the absolute value of the first current balance is not more than 30% of the absolute value of the second current balance.

3. An apparatus according to claim 1, wherein said discharge position is disposed upstream of said first and second cleaning positions in the rotational moving direction of said intermediary transfer belt.

4. An apparatus according to claim 3, wherein said first cleaning position is disposed upstream of said second cleaning position in the rotational moving direction of said intermediary transfer belt.

5. An apparatus according to claim 1, wherein said discharge position is disposed upstream of said first cleaning position and downstream of said second cleaning position, in the rotational moving direction of said intermediary transfer belt.

6. An apparatus according to claim 4, further comprising a controller configured to execute an operation in a control mode in which a test toner image is formed in a non-image area of said intermediary transfer belt and is fed to said discharge position without being transferred onto the recording material, wherein an absolute value of the discharge current at the time when the non-image area of said intermediary transfer belt on which the test toner image is formed passes said discharge position is smaller than an absolute value of the second cleaning current at the time when the non-image area of said intermediary transfer belt on which the test toner image is formed passes said second cleaning position.

7. An apparatus according to claim 1, further comprising a controller configured to execute an operation in a control mode in which a test toner image is formed in a non-image area of said intermediary transfer belt and is fed to said discharge position without being transferred onto the recording material, wherein an absolute value of the discharge current at the time when the non-image area of said intermediary transfer belt on which the test toner image is formed passes said discharge position is smaller than an absolute value of the discharge current at the time when the image area of said intermediary transfer belt on which the toner image to be transferred to the recording material is formed passes said discharge position.

8. An apparatus according to claim 1, wherein said apparatus comprises a plurality of said image bearing members, and a plurality of said primary transfer members provided for said image bearing members, respectively.

9. An apparatus according to claim 1, wherein said intermediary transfer belt has an elastic layer including an ion-conductive agent.

10. An apparatus according to claim 1, wherein the absolute value of the second cleaning current is 10-40 μA.

11. An image forming apparatus comprising:

an image bearing member configured to carry a toner image;

an intermediary transfer belt configured to receive the toner image from said image bearing member;

a primary transfer member provided in contact with said intermediary transfer belt at a primary transfer position and configured to primary-transfer the toner image from said image bearing member onto said intermediary transfer belt;

a secondary transfer member provided in contact with said intermediary transfer belt at a secondary transfer position and configured to secondary-transfer the toner image from said intermediary transfer belt onto the recording material;

a first fur brush provided in contact with said intermediary transfer belt at a first cleaning position downstream of said secondary transfer position and upstream of said primary transfer position in a rotational moving direction of said intermediary transfer belt, said first fur brush being configured to collect the toner charged to a polarity opposite to a regular polarity from said intermediary transfer belt with a first current flowing between said intermediary transfer belt and said first fur brush;

a second fur brush provided in contact with said intermediary transfer belt at a second cleaning position downstream of said first cleaning position and the upstream of said primary transfer position in the rotational moving direction of said intermediary transfer belt, said second fur brush being configured to collect the toner charged to the regular polarity from said intermediary transfer belt with a second current flowing between said intermediary transfer belt and said second fur brush;

a controller configured to execute an operation in a control mode in which a test toner image is formed in a non-image area of said intermediary transfer belt and is passed through said secondary transfer position without being transferred onto the recording material; and a third fur brush provided in contact with said intermediary transfer belt at a third cleaning position downstream of said secondary transfer position and upstream of said first cleaning position in the rotational moving direction of said intermediary transfer belt, said third fur brush being configured to collect the test toner image charged to the regular polarity from said intermediary transfer belt with a third current flowing between said intermediary transfer belt and said third fur brush, wherein an absolute value of the third current at the time when an image area of said intermediary transfer belt on which the toner image to be transferred to the recording material is formed passes said third cleaning position is larger than the absolute value of the third current at the time when the non-image area of said intermediary transfer belt passes said third cleaning position.

12. An apparatus according to claim 11, wherein the absolute value of the third current at the time when the image area of said intermediary transfer belt passes said third cleaning position is larger than an absolute value of the second cleaning current at the time when the image area of said intermediary transfer belt passes the second cleaning position.

13. An apparatus according to claim 12, wherein an absolute value of a first current balance is not more than 50% of an absolute value of a second current balance, wherein the first current balance is a sum of the primary transferring current, the secondary-transfer current, the first current, the second current, and the third current at the time when the image area of said intermediary transfer belt passes the primary transfer position, the secondary transfer position, the first cleaning position, the second cleaning position, and the third cleaning position, respectively, and the second current balance is the first current balance minus the third current at the time when the image area of said intermediary transfer belt passes the third cleaning position, when a current flowing in a direction from an inner surface side toward an outer peripheral surface side of said intermediary transfer belt is taken as positive current.

14. An apparatus according to claim 13, wherein said intermediary transfer belt has an elastic layer including an ion-conductive agent.

15. An apparatus according to claim 13, wherein when a current flowing in a direction from an inner surface side toward an outer peripheral surface side of said intermediary transfer belt is taken as positive current, the second current and the third current are negative current at the time when the image area of said intermediary transfer belt passes the second cleaning position and the third cleaning position, respectively.

16. An apparatus according to claim 15, wherein the absolute value of the second cleaning current is 10-40 μA.

* * * * *